US012668894B2

(12) United States Patent
Man et al.

(10) Patent No.: US 12,668,894 B2
(45) Date of Patent: Jun. 30, 2026

(54) SPINNING-DRAWING-WINDING DEVICE AND COMBINED MACHINE FOR INDUSTRIAL POLYLACTIC-ACID FIBER

(71) Applicant: BEIJING CHONGLEE MACHINERY ENGINEERING CO., LTD., Beijing (CN)

(72) Inventors: Xiaodong Man, Beijing (CN); Junxian Qiu, Beijing (CN); Kai Xu, Beijing (CN); Yubo Mao, Beijing (CN); Yadi Li, Beijing (CN); Yuguo Ren, Beijing (CN); Bo Hou, Beijing (CN); Baocheng Zhang, Beijing (CN); Hai Jiao, Beijing (CN); Yan Wu, Beijing (CN); Ruixin Sun, Beijing (CN); Lei Zhang, Beijing (CN); Yu Dong, Beijing (CN)

(73) Assignee: BEIJING CHONGLEE MACHINERY ENGINEERING CO., LTD., Beijing (CN)

( * ) Notice: Subject to any disclaimer, the term of this patent is extended or adjusted under 35 U.S.C. 154(b) by 231 days.

(21) Appl. No.: 18/614,598

(22) Filed: Mar. 22, 2024

(65) Prior Publication Data

US 2024/0229302 A1 Jul. 11, 2024

Related U.S. Application Data

(63) Continuation of application No. PCT/CN2022/122719, filed on Sep. 29, 2022.

(30) Foreign Application Priority Data

Sep. 30, 2021 (CN) ..... 202111160423.6
Sep. 30, 2021 (CN) ..... 202111163325.8
(Continued)

(51) Int. Cl.
*D01D 5/08* (2006.01)
*D01D 7/00* (2006.01)
(Continued)

(52) U.S. Cl.
CPC ..... *D01D 7/00* (2013.01); *D01D 5/08* (2013.01); *D01D 10/02* (2013.01); *D01F 6/625* (2013.01);
(Continued)

(58) Field of Classification Search
None
See application file for complete search history.

(56) References Cited

U.S. PATENT DOCUMENTS

2013/0267139 A1* 10/2013 Kim ..... D03D 1/02 264/210.8
2017/0368507 A1* 12/2017 Bauer ..... B01D 67/0095
2022/0126481 A1* 4/2022 Lee ..... B29C 48/54

FOREIGN PATENT DOCUMENTS

CN 201817591 U 5/2011
CN 105937061 A * 9/2016 ..... D01D 10/02
(Continued)

OTHER PUBLICATIONS

International Search Report prepared by the State Intellectual Property Office of the P.R. China for PCT/CN2022/122719, Dec. 28, 2022, 4 pages.
(Continued)

*Primary Examiner* — Farah Taufiq
(74) *Attorney, Agent, or Firm* — Syncoda LLC; Feng Ma

(57) ABSTRACT

A spinning-drawing-winding device for industrial polylactic-acid fiber includes a double-surface oiling mechanism, a filament shearing-suctioning device, a pre-interlacer and a splitting filament roller disposed in sequence according to a production process; a drawing-winding device cooperates
(Continued)

with a spinning device, a tow passing from the spinning device through the double-surface oiling mechanism, the filament shearing-suctioning device, and the pre-interlacer in sequence until the tow is conveyed to the splitting filament roller; the drawing-winding device and the spinning device are configured as a parallel configuration, so that the tow between the spinning device and the splitting filament roller are arranged in a vertical direction and is tangential to the splitting filament roller, and therefore the tow is without deflection, thereby avoiding damaging the tow due to a friction caused by a higher deflection.

14 Claims, 18 Drawing Sheets

(30) Foreign Application Priority Data

Sep. 30, 2021 (CN) ..... 202122406535.7
Sep. 30, 2021 (CN) ..... 202122406547.X

(51) Int. Cl.
*D01D 10/02* (2006.01)
*D01F 6/62* (2006.01)
*D01F 11/00* (2006.01)

(52) U.S. Cl.
CPC ..... *D01F 11/00* (2013.01); *D10B 2331/041* (2013.01)

(56) References Cited

FOREIGN PATENT DOCUMENTS

| | | | | | |
|---|---|---|---|---|---|
| CN | 106801262 | A | | 6/2017 | |
| CN | 108642583 | A | | 10/2018 | |
| CN | 108707987 | A | * | 10/2018 | ..... D01D 5/30 |
| CN | 110067033 | A | | 7/2019 | |
| CN | 108642583 | B | * | 4/2021 | ..... D01D 5/092 |
| KR | 20100003249 | A | * | 1/2010 | ..... D02G 3/36 |

OTHER PUBLICATIONS

Written Opinion prepared by the State Intellectual Property Office of the P.R. China for PCT/CN2022/122719, Dec. 28, 2022, 5 pages.

* cited by examiner

SPINNING-DRAWING-WINDING DEVICE AND COMBINED MACHINE FOR INDUSTRIAL POLYLACTIC-ACID FIBER

CROSS-REFERENCE TO RELATED APPLICATIONS

This is a continuation of International Application No. PCT/CN2022/122719 filed on Sep. 29, 2022, which claims priority to Chinese patent application Ser. No. 202122406547.X filed on Sep. 30, 2021, Chinese patent application Ser. No. 202111163325.8 filed on Sep. 30, 2021, Chinese patent application Ser. No. 202122406535.7 filed on Sep. 30, 2021, and Chinese patent application Ser. No. 202111160423.6 filed on Sep. 30, 2021. The disclosures of the above-referenced applications are hereby incorporated by reference in their entirety.

BACKGROUND

Most of the existing spinning-drawing-winding apparatuses for industrial polylactic-acid fiber filament are modified from other types of apparatuses and have a biggest disadvantage that the product quality and performance are unstable.

A bio-based polylactic-acid tow is relatively fragile compared to a petroleum synthetic fiber. In order to avoid damage caused by strong deflection and twining and to avoid different physical properties, a deflection of a filament thread is not allowed to exceed a certain limit value.

SUMMARY

The disclosure relates to the technical field of production of yarn, and in particular to a spinning-drawing-winding device and a combined machine for industrial polylactic-acid fiber.

Based on the above problems, the disclosure provides a spinning-drawing-winding device and a combined machine for industrial polylactic-acid fiber.

In one aspect of the disclosure, a spinning-drawing-winding device for industrial polylactic-acid fiber is provided, including a double-surface oiling mechanism, a filament shearing-suctioning device, a pre-interlacer and a splitting filament roller disposed in sequence according to a production process; the drawing-winding device cooperates with a spinning device; and a tow passes from the spinning device through the double-surface oiling mechanism, the filament shearing-suctioning device, and the pre-interlacer in sequence until the tow is conveyed to the splitting filament roller; and the drawing-winding device and the spinning device are configured as a parallel configuration, so that the tow between the spinning device and the splitting filament roller is arranged in a vertical direction and is tangential to the splitting filament roller.

In another aspect of the disclosure, a combined spinning-drawing-winding machine for industrial polylactic-acid fiber is provided, including a spinning device and a drawing-winding device. The spinning device includes: a screw extruder, an extrusion head, a melt delivering pipe, a spinning box, a spinning assembly, a heat-retarder, a monomer suction component, a combined cooling mechanism and a spinning channel component which are disposed in sequence according to a production process. The drawing-winding device includes: a double-surface oiling mechanism, a filament shearing-suctioning device, a pre-interlacer, a splitting filament roller, a first pair of low-temperature hot rollers, a second pair of high-temperature drawing hot rollers, a third pair of high-temperature drawing hot rollers, a fourth pair of drawing-setting hot rollers and a fifth group of setting hot rollers, a sixth slacking guide disc, a porcelain guiding filament hook, a main interlacer and a winding machine which are disposed in sequence according to the production process. A tow sequentially passes, from the spinning channel component, through the double-surface oiling mechanism, the filament shearing-suctioning device and the pre-interlacer until the tow is conveyed to the splitting filament roller. The drawing-winding device and the spinning device are configured as a parallel configuration, so that the tow between the spinning device and the splitting filament roller is arranged in a vertical direction and is tangential to the splitting filament roller.

The advantageous effects of the disclosure are as follows: the disclosure provides a drawing-winding device for industrial polylactic-acid fiber; the tow enters the drawing-winding device through the spinning device; the spinning device and the drawing-winding device are arranged with the parallel configuration in terms of equipment layout in this disclosure; specifically, the tow passes from the spinning device through the double-surface oiling mechanism, the filament shearing-suctioning device, and the pre-interlacer in sequence until the tow is conveyed to the splitting filament roller, so that the tow between the spinning device and the splitting filament roller is arranged in a vertical direction and is tangential to the splitting filament roller. With this parallel arrangement, the tow is led out from the spinning device and enters the drawing-winding device without deflection, thereby avoiding damaging the tow due to a friction caused by a higher deflection especially when the spinning device and the drawing-winding device applied in a production of an industrial polylactic-acid fiber FDY (Fully drawn yarn).

DETAILED DESCRIPTION

Embodiment One

Figure 1:
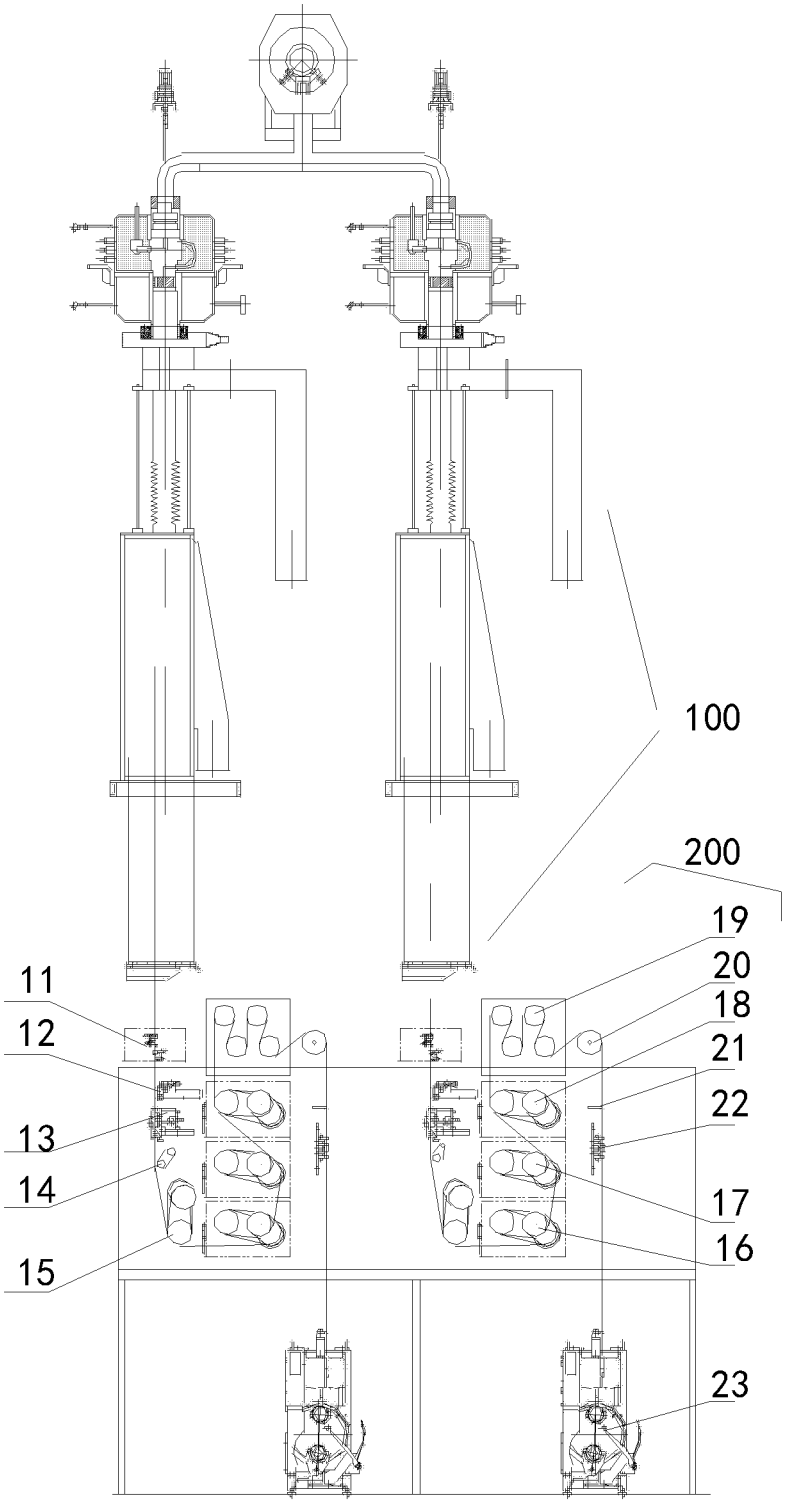
FIG. 1 shows a front view of a spinning-drawing-winding device for industrial polylactic-acid fiber and a spinning device according to Embodiment One of the disclosure.
Figure 2:
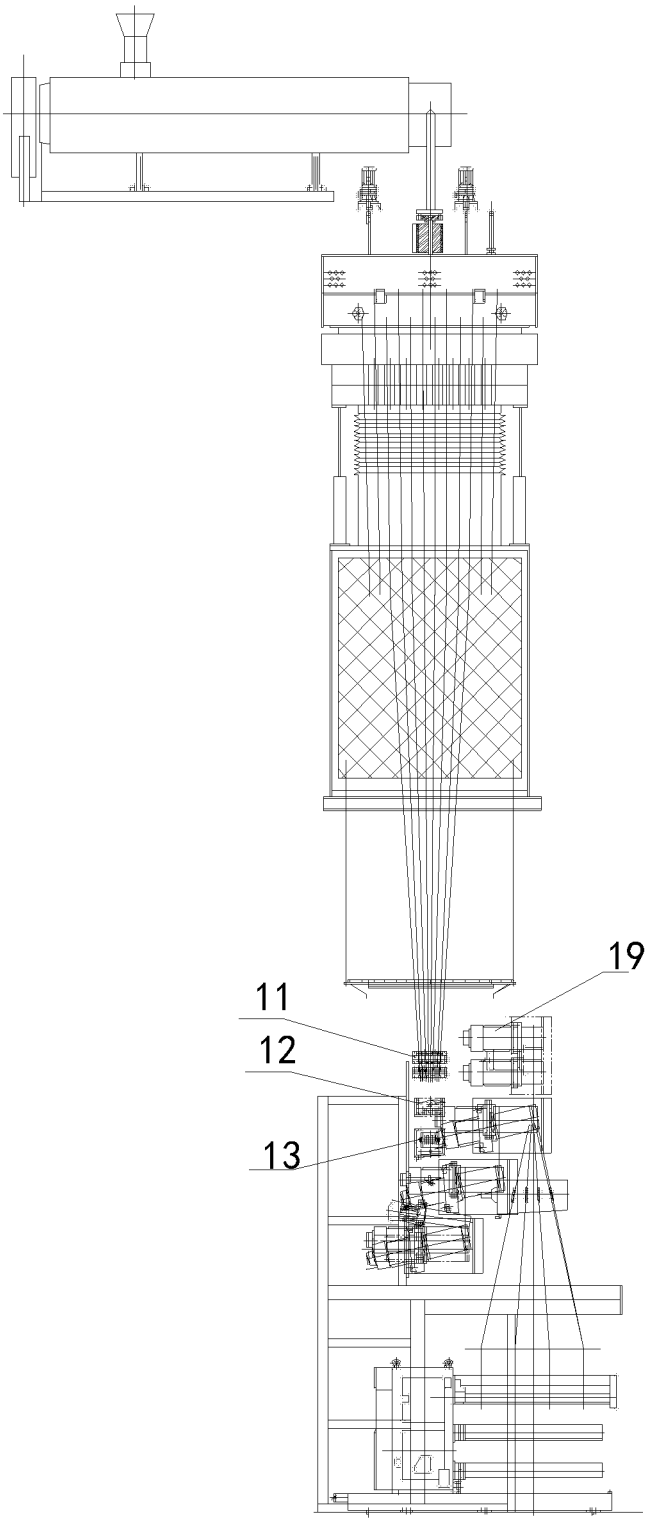
FIG. 2 is a side view of a structure shown in the FIG. 1.
Figure 3:
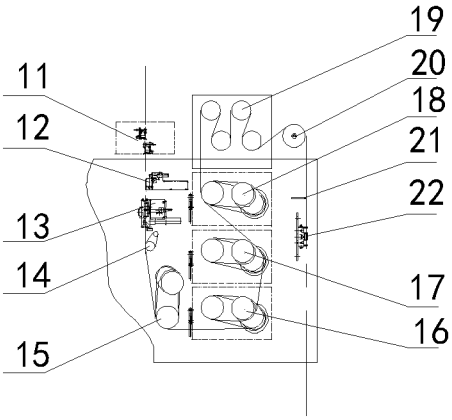
FIG. 3 is a partial structural schematic diagram of a drawing-winding device in FIG. 1.

Referring to FIG. 1 to FIG. 3, this embodiment discloses a spinning-drawing-winding device for industrial polylactic-acid fiber 200, which includes a double-surface oiling mechanism 11*a* filament shearing-suctioning device 12, and a pre-interlacer 13, and a splitting filament roller 14 which are disposed in sequence according to a production process. The drawing-winding device 200 cooperates with a spinning device 100 to form a combined machine. A tow sequentially passes, from the spinning device 100, through the double-surface oiling mechanism 11, the filament shearing-suctioning device 12 and the pre-interlacer 13 until the tow is conveyed to the splitting filament roller 14. The drawing-winding device 200 and the spinning device 100 are configured as a parallel configuration. That is, the spinning device 100 and the drawing-winding device 200 are arranged with the parallel configuration in terms of equipment layout, so that the tow between the spinning device 100 and the splitting filament roller 14 is arranged in a vertical direction and is tangential to the splitting filament roller 14. With this parallel arrangement, the tow is led out from the spinning device 100 and then enters the drawing-winding device 200 without deflection, thereby avoiding damaging the tow due to a friction caused by a higher deflection especially when the spinning-drawing-winding device for industrial polylactic-acid fiber 200 is applied in a production of an industrial polylactic-acid fiber FDY (Fully drawn yarn).

In some embodiments, the splitting filament roller 14 includes a pair of tension splitting filament rollers or a feeding roller. When the splitting filament roller 14 includes a pair of tension splitting filament rollers, it is beneficial to space arrangement and cost saving. The splitting filament roller 14, when including the feeding roller, has a certain grip on a filament, which is convenient for splitting the filament.

Figure 4:
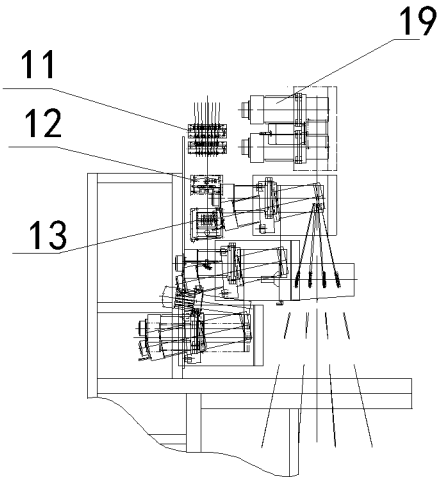
FIG. 4 is a side view of a structure shown in the FIG. 3.

In some embodiments, referring to FIG. 3 and FIG. 4. The drawing-winding device 200 includes a double-surface oiling mechanism 11, a filament shearing-suctioning device 12, a pre-interlacer 13, a splitting filament roller 14, a first pair of low-temperature hot rollers 15, a second pair of high-temperature drawing hot rollers 16, a third pair of high-temperature drawing hot rollers 17, a fourth pair of drawing-setting hot rollers 18 and a fifth group of setting hot rollers 19 which are disposed in sequence according to the production process.

Different from other types of yarn such as a polyester, when a polylactic-acid fiber is heated to a certain temperature, the fiber changes in a molecular structure, and in turn is set. Due to characteristics of a polylactic-acid fiber, a setting of an industrial polylactic-acid fiber yarn is not maturity because of requirements for higher setting length and setting time.

Figure 6:
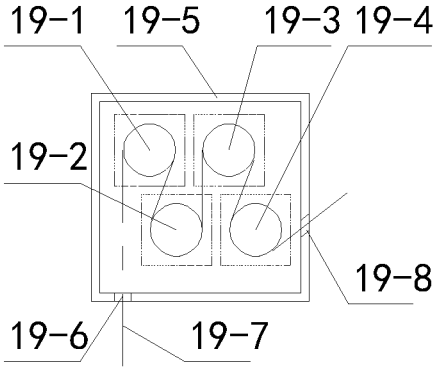
FIG. 6 is a front view of the fifth group of setting hot rollers in FIG. 1 with an inductive heating source.

Referring to FIG. 6, in this embodiment, the fifth group of setting hot rollers 19 includes a thermal insulation cover box 19-5, a heating source and at least four heat-setting rollers. The thermal insulation cover box 19-5 is opened with a filament entering channel 19-6 and a filament out channel 19-7 for the tow to pass therethrough. The at least four heat-setting rollers are disposed in sequence according to the production process and are all disposed within the thermal insulation cover box 19-5. The heating source is used to heat the tow 19-7 within the thermal insulation cover box 19-5 in an environment of 70-120° C.

In the above specific way that the fifth group of setting hot rollers 19 are used to replace a traditional pair of setting rollers, the number of heat-setting rollers is increased and the heat-setting rollers are all disposed within the thermal insulation cover box 19-5, and therefore a path and a spinning route are increased within a limited space, which is conducive to meeting strict requirements on setting length and setting time when a polylactic-acid yarn is spun, and therefore a setting effect can be made more sufficient.

In some embodiments, a speed of various heat-setting rollers of the fifth group of setting hot rollers 19 may be regulated separately, which is beneficial to regulating and controlling a setting step.

In some embodiments, the fifth group of setting hot rollers 19 needs to ensure that the tow 19-7 enters the thermal insulation cover box 19-5 in an upward direction and is output in a downward direction, and therefore the number of heat-setting rollers in the thermal insulation cover box 19-5 is better to be controlled as 4, and it is also better to be set as 6, 8 and so on.

Figure 5:
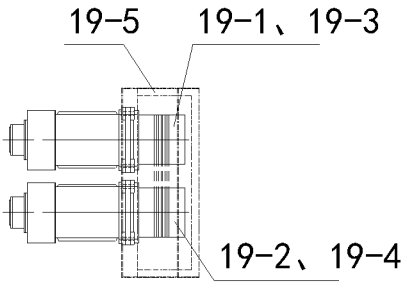
FIG. 5 is a side view of a fifth group of setting hot rollers in FIG. 1.

In some embodiments, referring to FIG. 5 and FIG. 6, the fifth group of setting hot rollers 19 may include four heat-setting rollers, which are a first heat-setting roller 19-1, a second heat-setting roller 19-2, a third heat-setting roller 19-3 and a fourth heat-setting roller 19-4 disposed in sequence according to the production process. The tow 19-7 passes through the filament entering channel 19-6 and is wound through the first heat-setting roller 19-1, the second heat-setting roller 19-2, the third heat-setting roller 19-3 and the fourth heat-setting roller 19-4, until the tow passes through the filament out channel 19-8. As shown in FIG. 6, the first heat-setting roller 19-1 is disposed to be higher than the second heat-setting roller 19-2, and a height of the third heat-setting roller 19-3 is equal to that of the first heat-setting roller 19-1, and a height of the fourth heat-setting roller 19-4 is equal to that of the second heat-setting roller 19-2.

In some embodiments, the heating source includes an inductive heating source, a steam heating source, or a hot air heating source.

As shown in FIG. 6, the heating source is, when including an inductive heating source, used to perform a heat-setting on an industrial polylactic-acid fiber yarn with a setting temperature within a first preset range. The heat-setting rollers are all configured as heat-setting rollers heated through inductive heating. With a setting through an inductive heating, the industrial polylactic-acid fiber yarn is relatively uniformly heated, but an electricity consumption is heavy and a cost is high. The setting through the inductive heating is used for setting an industrial bio-based polylactic-acid filament which needs a higher setting temperature and has relatively high requirements on various indicators.

Figure 7:
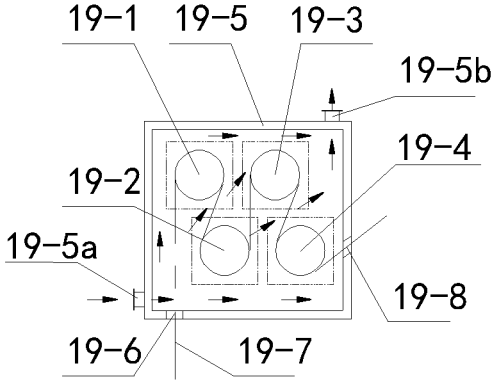
FIG. 7 is a front view of the fifth group of setting hot rollers in FIG. 1 with a steam heating source.

As shown in FIG. 7, the heating source is, when including a steam heating source, used to heat-set an industrial polylactic-acid fiber yarn with a setting temperature within a second preset range. A steam inlet 19-5*a* is opened at a lower portion of a side wall of the thermal insulation cover box 19-5. A steam outlet 19-5*b* is opened at a higher portion of the side wall of the thermal insulation cover box 19-5. The steam inlet 19-5*a* and the steam outlet 19-5*b* are opened at two opposite sides of the thermal insulation cover box 19-5, such that the steam heating source can delivery a hot steam into the thermal insulation cover box 19-5. Specifically, the hot steam is inputted into the thermal insulation cover box 19-5 via the steam inlet 19-5*a*, and the hot steam is, after heat-setting the tow 19-7, output via the steam outlet 19-5*b*.

Figure 8:
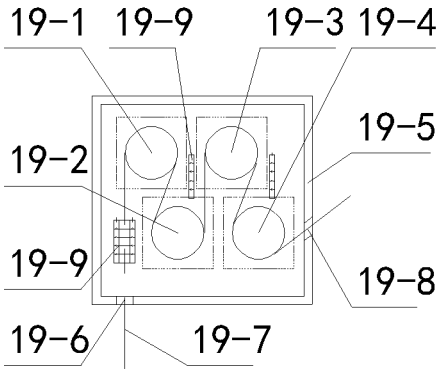
FIG. 8 is a front view of the fifth group of setting hot rollers in FIG. 1 with a hot air heating source.

As shown in FIG. 8, the heating source is, when including a hot air heating source, used to heat-set an industrial polylactic-acid fiber yarn with a setting temperature within a third preset range. A plurality of heating plates are provided within the thermal insulation cover box 19-5. The heating plates 19-9 are disposed at an interval from the heat-setting rollers, and the heating plates 19-9 are disposed close to the tow 19-7 in the thermal insulation cover box 19-5. A heat-setting process can be performed by the heating plate 19-9, and therefore a temperature can be controlled by the heating plate 19-9.

The polylactic-acid fiber, due to a nature thereof, generally requires a setting temperature of no more than 120° C. and no less than 70° C. In an embodiment, the first preset range, the second preset range, and the third preset range decrease in sequence, and are all greater than or equal to 70° C. and less than or equal to 120° C. The inductive heating source, the steam heating source or the hot air heating source is selected in turn according to a decreasing of the setting temperature.

In some embodiments, the first preset range is greater than 110° C. and less than or equal to 120° C.; the second preset range is greater than 90° C. and less than or equal to 110° C.; and the third preset range is greater than or equal to 70° C. and less than or equal to 90° C.

In some embodiments, a setting through an inductive heating is used for an industrial polylactic-acid filament with a setting temperature of 110° C. to 120° C.

In some embodiments, a setting through a steam heating is used for an industrial polylactic-acid filament with a setting temperature of 95° C. to 105° C.

In some embodiments, a setting through a hot air heating is used for an industrial polylactic-acid filament with a setting temperature of 70° C. to 90° C.

In some embodiments, as shown in FIG. 8, during a setting through hot air heating, the heating plates 19-9 include heating plates disposed at an entrance of the thermal insulation cover box 19-5 and heating plates disposed among subsequent heat-setting rollers. Since a temperature of an area at the entrance, which is behind the filament entering channel 19-6, changes relatively large, it is configured that the tow 19-7 passes through the heating plates 19-9 at the entrance, and a cross section of the corresponding heating plates 19-9 is U-shaped. The subsequent heating plates 19-9 are disposed between two heat-setting rollers, and thus it is conducive to a spatial arrangement in the thermal insulation cover box 19-5 and is conducive to an arrangement of the thermal insulation cover box 19-5 with a smaller size.

In some embodiments, as shown in FIG. 1 and FIG. 3, the drawing-winding device 200 also includes, after the fifth group of setting hot rollers 19, a sixth slacking guide disc 20, a porcelain guiding filament hook 21, a main interlacer 22 and a winding machine 23 disposed in sequence according to the production process. The sixth slacking guide disc 20 plays a role of slacking and eliminating tension. The tow after wound on the sixth slacking guide disk 20 passes through the porcelain guiding filament hook 21 to be sent to the main interlacer 22 for knotting. The tow after being knotted is sequentially conveyed to the winding machine 23 to complete a winding.

The spinning-drawing-winding device for industrial polylactic-acid fiber 200 of this embodiment can produce different types of industrial bio-based polylactic-acid filaments with 4-16 heads.

Embodiment Two

Based on the spinning-drawing-winding device for industrial polylactic-acid fiber 200 in Embodiment One, specific parameters of the splitting filament roller 14, the first pair of low-temperature hot rollers 15, the second pair of high-temperature drawing hot rollers 16, the third pair of high-temperature drawing hot rollers 17, the fourth pair of drawing-setting hot rollers 18, and the fifth group of setting hot rollers 19 are set in this embodiments.

In some embodiments, the splitting filament roller 14 is wound by the tow for one circle, has a heating temperature of zero, that is, in a non-heating state, and has a spinning speed of 550-650 m/min.

The first pair of low-temperature hot rollers 15 are wound by the tow for 6.5 circles to 7.5 circles, and have a heating temperature of 65-90° C. and a spinning speed of 605 m/min. The splitting filament roller 14 and the first pair of low-temperature hot rollers 15 maintain a speed ratio of 1:1.01.

The second pair of high-temperature drawing hot rollers 16 are wound by the tow for 6.5 circles to 7.5 circles and have a heating temperature of 100-140° C. and a spinning speed of 1950 m/min. A draw multiple of the first pair of low-temperature hot rollers 15 and the second pair of high-temperature drawing hot rollers 16 is 2.5-3.5 times.

The third pair of high-temperature drawing hot rollers 17 are wound by the tow for 6.5 circles to 7.5 circles and have a heating temperature of 110-150° C. and a spinning speed of 3500 m/min. A draw multiple of the second pair of high-temperature drawing hot rollers 16 and the third pair of high-temperature drawing hot rollers 17 is 1.5-2 times.

The fourth pair of drawing-setting hot rollers 18 are wound by the tow for 6.5 circles to 7.5 circles and have a heating temperature of 110-150° C. and a spinning speed of 3900 m/min. A draw multiple of the third pair of high-temperature drawing hot rollers 17 and the fourth pair of drawing-setting hot rollers 18 is 1.1-1.3 times.

The fifth group of setting hot rollers 19 have a heating temperature of 70-120° C. and a spinning speed of 4250 m/min, and a draw multiple of the fourth pair of drawing-setting hot rollers 18 and the fifth group of setting hot rollers 19 is 1.02-1.05 times.

In some embodiments, a heating temperature of the sixth slacking guide disc 20 is zero, that is, in a non-heating state.

In some embodiments, surfaces of roller shells of the splitting filament roller 14, the first pair of low-temperature hot rollers 15, the second pair of high-temperature drawing hot rollers 16, the third pair of high-temperature drawing hot rollers 17, the fourth pair of drawing-setting hot rollers 18, the fifth group of setting hot rollers 19 and the sixth slacking guide disc 20 may all be made of ceramics.

Embodiment Three

Figure 9:
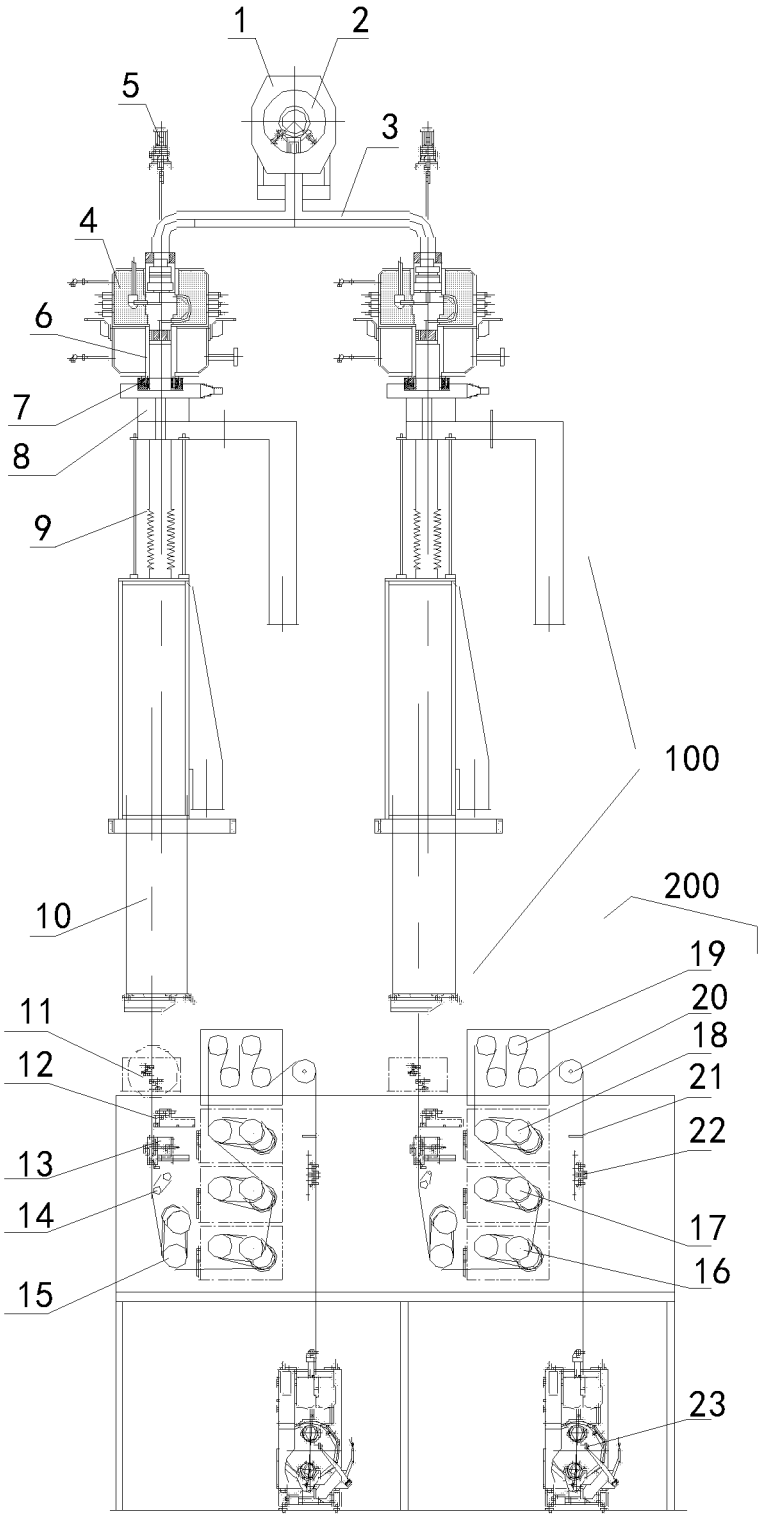
FIG. 9 shows a front view of a combined spinning-drawing-winding machine for industrial polylactic-acid fiber according to Embodiment Three of the disclosure.
Figure 10:
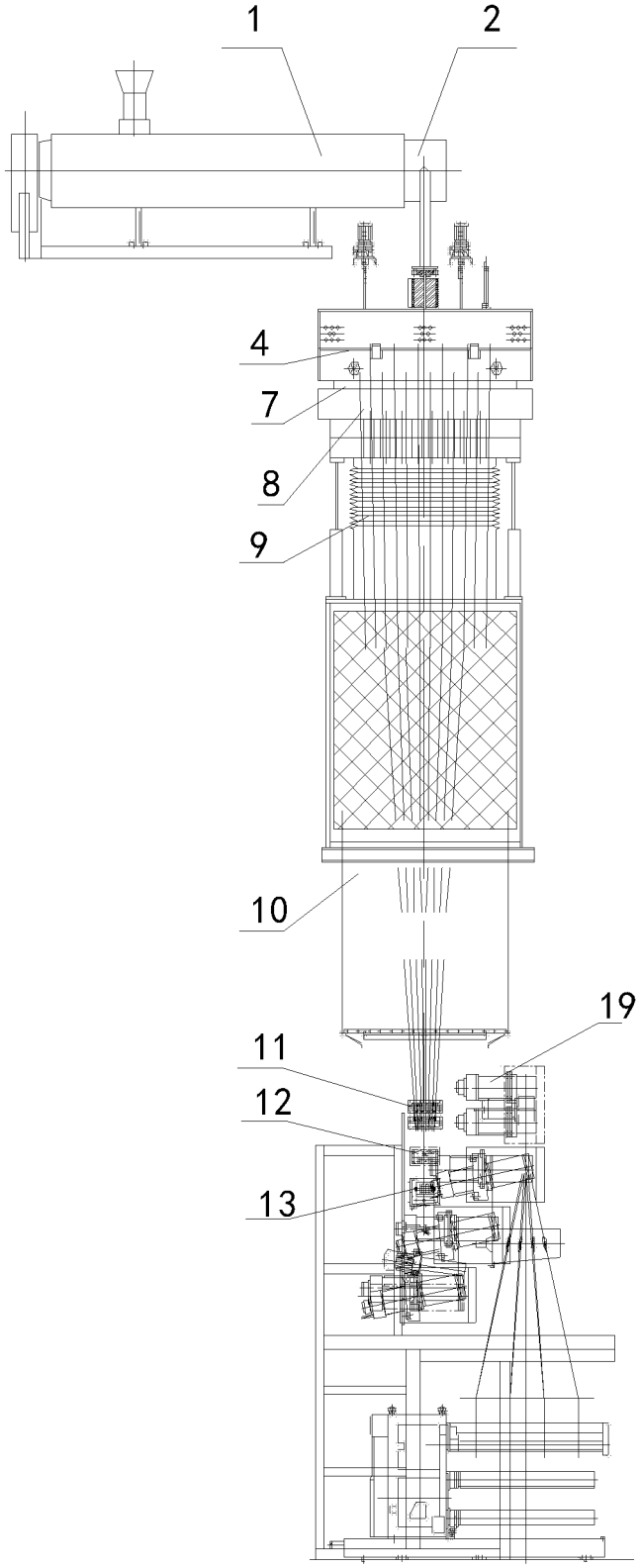
FIG. 10 is a side view of a structure shown in the FIG. 9.
Figure 11:
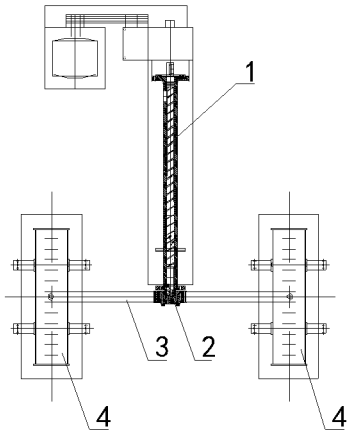
FIG. 11 is a top view of a screw extruder, an extrusion head, a melt delivering pipe and a spinning box in FIG. 9.

Referring to FIG. 9 to FIG. 11, this embodiment provides a combined spinning-drawing-winding machine for industrial polylactic-acid fiber, including a spinning device 100 and a drawing-winding device 200. The spinning device includes: a screw extruder 1, an extrusion head 2, a melt delivering pipe 3, a spinning box 4, a spinning assembly 6, a heat-retarder 7, a monomer suction component 8, a combined cooling mechanism 9 and a spinning channel component 10 which are disposed in sequence according to the production process. The drawing-winding device 200 includes: a double-surface oiling mechanism 11, a filament shearing-suctioning device 12, a pre-interlacer 13, a splitting filament roller 14, a first pair of low-temperature hot rollers 15, a second pair of high-temperature drawing hot rollers 16, a third pair of high-temperature drawing hot rollers 17, a fourth pair of drawing-setting hot rollers 18 and a fifth group of setting hot rollers 19, a sixth slacking guide disc 20, a porcelain guiding filament hook 21, a main interlacer 22 and a winding machine 23 which are disposed in sequence according to the production process. A tow sequentially passes, from the spinning channel component 10, through the double-surface oiling mechanism 11, the filament shearing-suctioning device 12 and the pre-interlacer 13 until the tow is conveyed to the splitting filament roller 14. The drawing-winding device 200 and the spinning device 100 are configured as a parallel configuration, so that the tow between the spinning device 100 and the splitting filament roller 14 is arranged in a vertical direction and is tangential to the splitting filament roller 14.

With this parallel arrangement, the tow is led out from the spinning device 100 and then enters the drawing-winding device 200 without deflection, thereby avoiding a damage of the tow due to a friction caused by a higher deflection especially when the spinning device 100 and the drawing-winding device 200 are applied in a production of an industrial polylactic-acid fiber FDY (Fully drawn yarn).

The splitting filament roller 14 includes a pair of tension splitting filament rollers or a feeding roller. When the splitting filament roller 14 includes a pair of tension splitting filament rollers, it is beneficial to space arrangement and cost saving. The splitting filament roller 14, when including the feeding roller, has a certain grip on a filament, which is convenient for splitting the filament.

Different from other types of yarn such as a polyester, when a polylactic-acid is heated to a certain temperature, a fiber changes in a molecular structure, and in turn is set. Due to characteristics of a polylactic-acid fiber, a setting of an industrial polylactic-acid fiber yarn is not maturity because of requirements for higher setting length and setting time.

Figure 13:
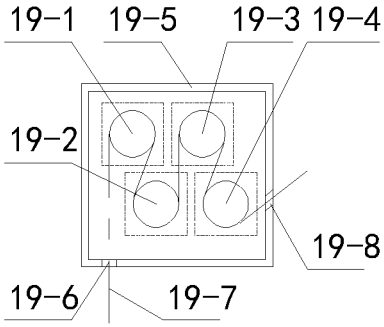
FIG. 13 is a front view of the fifth group of setting hot rollers in FIG. 9 with an inductive heating source.

Referring to FIG. 13, in this embodiment, the fifth group of setting hot rollers 19 may include a thermal insulation cover box 19-5, a heating source and at least four heat-setting rollers. The thermal insulation cover box 19-5 is opened with a filament entering channel 19-6 and a filament out channel 19-7 for the tow to pass through. The at least four heat-setting rollers are disposed in sequence according to the production process and are all disposed within the thermal insulation cover box 19-5. The heating source is used to heat the tow 19-7 within the thermal insulation cover box 19-5 in an environment of 70-120° C.

In the above specific scheme that a traditional pair of setting rollers are replaced with the fifth group of setting hot rollers 19, the number of setting hot rollers are increased and the setting hot rollers are all disposed within the thermal insulation cover box 19-5, and a path and a spinning route are increased within a limited space, and therefore it is conducive to meeting strict requirements on setting length and setting time when a polylactic-acid yarn is spun, and a setting effect can be made more sufficient. In some embodiments, a speed of various heat-setting rollers of the fifth group of setting hot rollers 19 may be regulated separately, which is beneficial to regulating and controlling a setting step. In some embodiments, the fifth group of setting hot rollers 19 needs to ensure that the tow 19-7 enters the thermal insulation cover box 19-5 in an upward direction and is output in a downward direction, and therefore the number of heat-setting rollers in the thermal insulation cover box 19-5 is better to be controlled as 4, and is also set as 6, 8 and so on.

Figure 12:
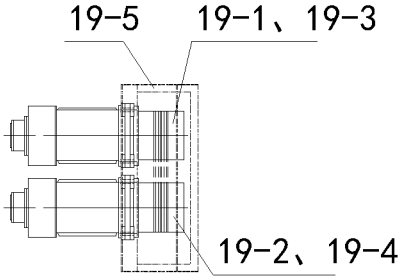
FIG. 12 is a side view of the fifth group of setting hot rollers in FIG. 9.

In some embodiments, referring to FIG. 12 and FIG. 13, the fifth group of setting hot rollers 19 may include four heat-setting rollers, which are a first heat-setting roller 19-1, a second heat-setting roller 19-2, a third heat-setting roller 19-3 and a fourth heat-setting roller 19-4 disposed in sequence according to the production process. The tow 19-7 passes through the filament entering channel 19-6 and winds through the first heat-setting roller 19-1, the second heat-setting roller 19-1, the third heat-setting roller 19-3 and the fourth heat-setting roller 19-4, until the tow passes through the filament out channel 19-8. As shown in FIG. 13, the first heat-setting roller 19-1 is disposed to be higher than the second heat-setting roller 19-2, and a height of the third heat-setting roller 19-3 is equal to that of the first heat-setting roller 19-1, and a height of the fourth heat-setting roller 19-4 is equal to that of the second heat-setting roller 19-2.

In some embodiments, the heating source may include an inductive heating source, a steam heating source, or a hot air heating source. As shown in FIG. 13, the heating source is, when including an inductive heating source, used to perform a heat-setting on an industrial polylactic-acid fiber yarn with a setting temperature within a first preset range. The heat-setting rollers are all configured as heat-setting rollers heated through inductive heating. With a setting through an inductive heating, the heating is relatively uniform, but an electricity consuming is heavy and a cost is high. The setting through the inductive heating is applied for industrial bio-based polylactic-acid filament which needs a higher setting temperature and has relatively high requirements on various indicators.

Figure 14:
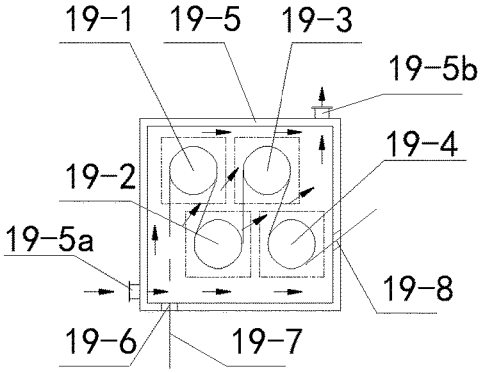
FIG. 14 is a front view of the fifth group of setting hot rollers in FIG. 9 with a steam heating source.

As shown in FIG. 14, the heating source is, when including a steam heating source, used to heat-set an industrial polylactic-acid fiber yarn with a setting temperature within a second preset range. A steam inlet 19-5*a* is opened at a lower portion of a side wall of the thermal insulation cover box 19-5. A steam outlet 19-5*b* is opened at a higher portion of the side wall of the thermal insulation cover box 19-5. The steam inlet 19-5*a* and the steam outlet 19-5*b* are opened at two opposite sides of the thermal insulation cover box 19-5, such that the steam heating source can delivery a hot steam into the thermal insulation cover box 19-5. Specifically, the hot steam is inputted into the thermal insulation cover box 19-5 via the steam inlet 19-5*a*, and the hot steam is, after heat-setting the tow 19-7, output via the steam outlet 19-5*b*.

Figure 15:
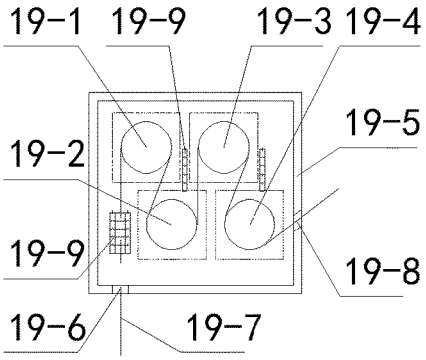
FIG. 15 is a front view of the fifth group of setting hot rollers in FIG. 9 with a hot air heating source.

As shown in FIG. 15, the heating source is, when including a hot air heating source, used to heat-set an industrial polylactic-acid fiber yarn with a setting temperature within a third preset range. A plurality of heating plates are provided within the thermal insulation cover box 19-5. The heating plates 19-9 are disposed at an interval from the heat-setting rollers, and the heating plates 19-9 are disposed close to the tow 19-7 in the thermal insulation cover box 19-5. A heat-setting process can be performed by the heating plate 19-9, and therefore a temperature can be controlled by the heating plate 19-9.

The polylactic-acid fiber, due to a nature thereof, generally requires a setting temperature of no more than 120° C. and no less than 70° C. In an embodiment, the first preset range, the second preset range, and the third preset range decrease in sequence, and are all greater than or equal to 70° C. and less than or equal to 120° C. The inductive heating source, the steam heating source or the hot air heating source is selected in turn according to a decreasing of the setting temperature. In some embodiments, the first preset range is greater than 110° C. and less than or equal to 120° C., the second preset range is greater than 90° C. and less than or equal to 110° C., and the third preset range is greater than or equal to 70° C. and less than or equal to 90° C. In some embodiments, a setting through an inductive heating is used for an industrial polylactic-acid filament with a setting temperature of 110° C. to 120° C. In some embodiments, a setting through a steam heating is used for an industrial polylactic-acid filament with a setting temperature of 95° C. to 105° C. In some embodiments a setting through a hot air heating is used for an industrial polylactic-acid filament with a setting temperature of 70° C. to 90° C.

In some embodiments, as shown in FIG. 15, during a setting through hot air heating, the heating plates 19-9 include heating plates disposed at an entrance of the thermal insulation cover box 19-5 and heating plates disposed among subsequent heat-setting rollers. Since a temperature of an area at the entrance, which is behind the filament entering channel 19-6, changes relatively large, it is configured that the tow 19-7 passes through the heating plate 19-9 at the entrance, and a cross section of the corresponding heating plates 19-9 are U-shaped. The subsequent heating plates 19-9 are disposed between two heat-setting rollers, and thus it is conducive to a spatial arrangement in the thermal insulation cover box 19-5 and is conducive to an arrangement of the thermal insulation cover box 19-5 with a smaller size.

In some embodiments, as shown in FIG. 9, the drawing-winding device 200 also may include, after the fifth group of setting hot rollers 19, a sixth slacking guide disc 20, a porcelain guiding filament hook 21, a main interlacer 22 and a winding machine 23 disposed in sequence according to the production process. The sixth slacking guide disc 20 plays a role of slacking and eliminating tension. The tow after wound on the sixth slacking guide disk 20 passes through the porcelain guiding filament hook 21 to be sent to the main interlacer 22 for knotting. The tow after being knotted is sequentially conveyed to the winding machine 23 to complete a winding.

The combined spinning-drawing-winding machine for industrial polylactic-acid fiber of this embodiment can produce different types of bio-based industrial polylactic-acid filaments with 4-16 heads.

Embodiment Four

Based on the combined spinning-drawing-winding machine for industrial polylactic-acid fiber of Embodiment Three, specific parameters for the splitting filament roller 14, the first pair of low-temperature hot rollers 15, the second pair of high-temperature drawing hot rollers 16, the third pair of high-temperature drawing hot rollers 17, the fourth pair of drawing-setting hot rollers 18 and the fifth group of setting hot rollers 19 are set in this embodiment. In some embodiments, the splitting filament roller 14 is wound by the tow for 1 circle, has a heating temperature of zero, that is, in a non-heating state, and has a spinning speed of 550-650 m/min. The first pair of low-temperature hot rollers 15 are wound by the tow for 6.5 circles to 7.5 circles and have a heating temperature of 65-90° C. and a spinning speed of 605 m/min. The splitting filament roller 14 and the first pair of low-temperature hot rollers 15 maintain a speed ratio of 1:1.01. The second pair of high-temperature drawing hot rollers 16 are wound by the tow for 6.5 circles to 7.5 circles and have a heating temperature of 100-140° C. and a spinning speed of 1950 m/min. A draw multiple of the first pair of low-temperature hot rollers 15 and the second pair of high-temperature drawing hot rollers 16 is 2.5-3.5 times. The third pair of high-temperature drawing hot rollers 17 are wound by the tow for 6.5 circles to 7.5 circles and have a heating temperature of 110-150° C. and a spinning speed of 3500 m/min. A draw multiple of the second pair of high-temperature drawing hot rollers 16 and the third pair of high-temperature drawing hot rollers 17 is 1.5-2 times. The fourth pair of drawing-setting hot rollers 18 are wound by the tow for 6.5 circles to 7.5 circles and have a heating temperature of 110-150° C. and a spinning speed of 3900 m/min. A draw multiple of the third pair of high-temperature drawing hot rollers 17 and the fourth pair of drawing-setting hot rollers 18 is 1.1-1.3 times. The fifth group of setting hot rollers 19 have a heating temperature of 70-120° C. and a spinning speed of 4250 m/min, and a draw multiple of the fourth pair of drawing-setting hot rollers 18 and the fifth group of setting hot rollers 19 is 1.02-1.05 times.

In some embodiments, a heating temperature of the sixth slacking guide disc 20 is zero, that is, in a non-heating state.

In some embodiments, surfaces of roller shells of the splitting filament roller 14, the first pair of low-temperature hot rollers 15, the second pair of high-temperature drawing hot rollers 16, the third pair of high-temperature drawing hot rollers 17, the fourth pair of drawing-setting hot rollers 18, the fifth group of setting hot rollers 19 and the sixth slacking guide disc 20 may all be made of ceramics.

Embodiment Five

Figure 16:
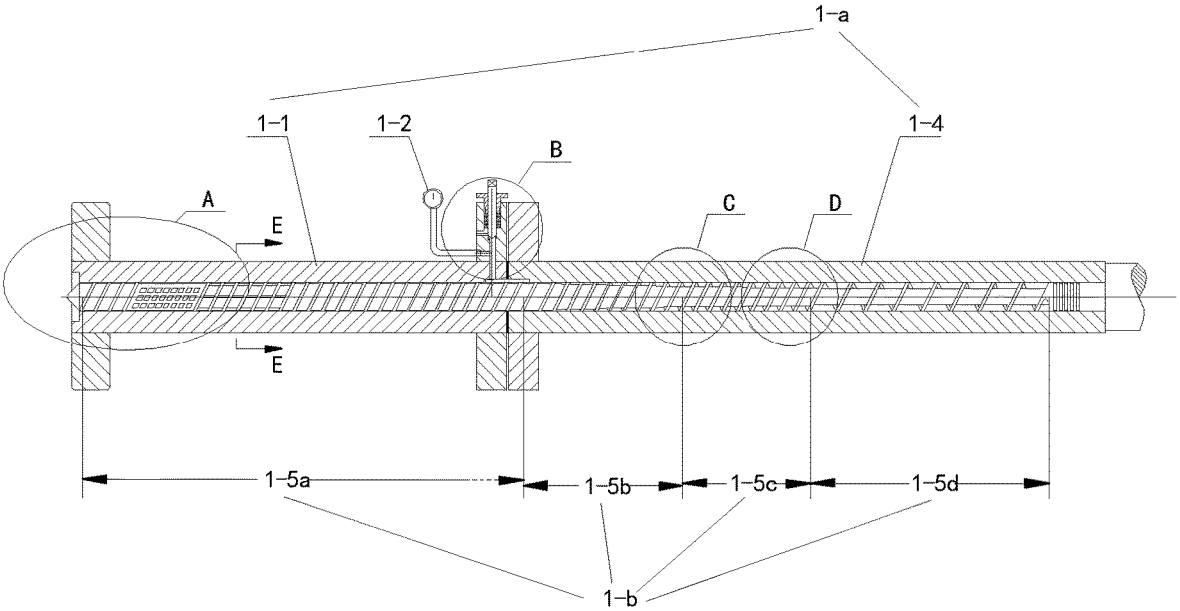
FIG. 16 is a schematic diagram of an overall structure of a screw extruder provided in Embodiment Five.
Figure 19:
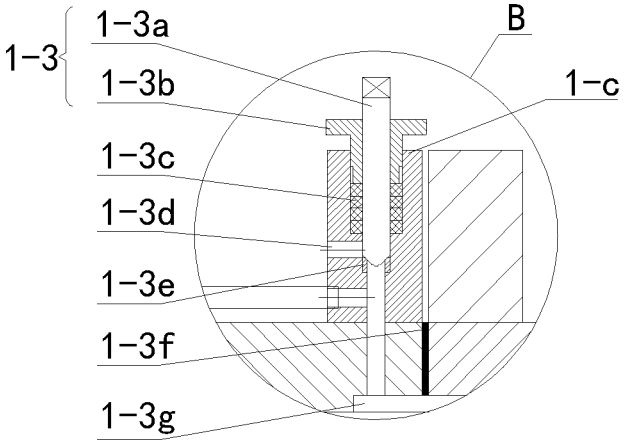
FIG. 19 is a partial enlarged diagram of a portion indicated by B in FIG. 16.

Based on the combined spinning-drawing-winding machine for industrial polylactic-acid fiber in Embodiment Three or Embodiment Four, referring to FIG. 16 and FIG. 19, this embodiment discloses a screw extruder, including a threaded sleeve 1-*a* and a threaded rod 1-*b* penetrating in the threaded sleeve 1-*a*. The threaded rod 1-*b* may include a feed section 1-5*d*, a compression section (represented as a first compression section 1-5*c* and a second compression section 1-5*b* as shown in FIG. 16, and also represented in other forms) and a metering section 1-5*a* which are disposed in sequence. The threaded sleeve 1-*a*includes a gas collection chamber 1-3*g* and an exhaust hole 1-3*d*. The gas collection chamber 1-3*g* is located on an inner wall of a junction of the compression section and the metering section 1-5. The exhaust hole 1-3*d* is in communication with the gas collection chamber 1-3*g*. In some embodiments, the threaded sleeve 1-*a* is equipped with an on-off valve 1-3 to open and close the exhaust hole 1-3*d*.

The threaded sleeve 1-*a* is equipped with an external heater at outside to provide heat. The threaded rod 1-*b* may include: the feed section 1-5*d*, the compression section and the metering section 1-5*a* which are disposed in sequence. A polylactic-acid raw material when entering the feed section 1-5*d*, changes gradually from a solid material into a molten melt with an increase of a temperature step by step and under an action of shear heat between raw materials. In the compression section, the solid material is fully melted to a liquid phase by compression and shear. When a bio-based polylactic-acid raw material is heated, structures of a small portion of the raw material become unstable and undergo chemical changes, resulting in a hydrolysis. A gas generated has a serious impact on subsequent spinning. The gas is collected through the gas collection chamber 1-3*g* located at an end of the compression section. The gas generated by the hydrolysis is discharged from the exhaust hole 1-3*d* by controlling the on-off valve 1-3. When the melt enters the metering section 1-5*a*, the gas is removed in time, thereby overcoming the serious adverse impact of the gas from the hydrolysis on the spinning. The unfavorable situation of end breakage is eliminated, and a subsequent spinning quality and a spinning efficiency are guaranteed.

In some embodiments, as shown in FIG. 16 and FIG. 19, the threaded sleeve 1-*a* may include a first threaded sleeve 1-1 and a second threaded sleeve 1-4 that are butted. The threaded rod 1-*b* is penetrated in the first threaded sleeve 1-1 and the second threaded sleeve 1-4. The first threaded sleeve 1-1 is provided with the exhaust hole 1-3*d* and mounted with the on-off valve 1-3. An inner wall of an end of the first threaded sleeve 1-1 close to the second threaded sleeve 1-4 is disposed with a recess. A sealing gasket 1-3*f* is provided between the first threaded sleeve 1-1 and the second threaded sleeve 1-4; and/or an inner wall of an end of the second threaded sleeve 1-4 close to the first threaded sleeve 1 is disposed with the recess, and the first threaded sleeve 1-1, the sealing gasket 1-3*f*, the second threaded sleeve 1-4 and the threaded rod 1-*b* together enclose a gas collection chamber 1-3*g*.

The threaded sleeve 1-*a* is disposed in a form of a combination of the first threaded sleeve 1-1 and the second threaded sleeve 1-4 to form the gas collection chamber 1-3*g*. In some embodiments, a sealing gasket 1-3*f* being disposed between the first threaded sleeve 1-1 and the second threaded sleeve 1-4 means that the sealing gasket 1-3*f* is disposed at a butting surface of the first threaded sleeve 1-1 and the second threaded sleeve 1. The first threaded sleeve 1-1 and the second threaded sleeve 1-4 can be connected by bolts, and the sealing gasket 1-3*f* is used to ensure a leakproofness of the gas collection chamber 1-3*g*.

In some embodiments, the above-described and/or an inner wall of an end of the second threaded sleeve 1-4 close to the first threaded sleeve 1 being disposed with the recess means that: based on the inner wall of the end of the first threaded sleeve 1-1 close to the second threaded sleeve 1-4 being disposed with the recess, an inner wall of an end of the second threaded sleeve 1-4 close to the first threaded sleeve 1-1 may be disposed with the recess to form a portion of the gas collection chamber 1-3*g*; or the inner wall of the end close to the second threaded sleeve 1-4 of the first threaded sleeve 1-1 may be disposed with the recess alone, or the inner wall of the end of the second threaded sleeve 1-4 close to the first threaded sleeve 1-1 may be disposed with the recess alone.

In some embodiments, the feed section 1-5*d* is configured as a single-thread threaded rod to complete a feeding; the compression section is configured as a double-thread threaded rod to reduce the shear heat of the compression section, thereby reducing an over-temperature phenomenon of the compression section.

Figure 22:
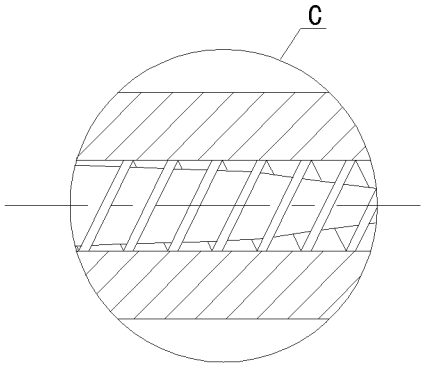
FIG. 22 is a partial enlarged diagram of a portion indicated by C in FIG. 16.
Figure 23:
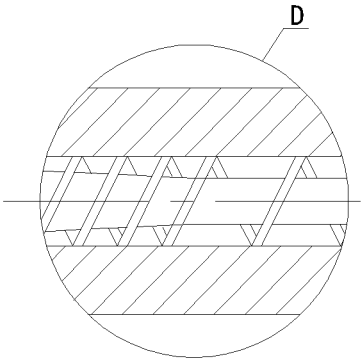
FIG. 23 is a partial enlarged diagram of a portion indicated by D in FIG. 16.

In some embodiments, referring to FIG. 16, FIG. 22 and FIG. 23, the compression section may include a first compression section 1-5*c* and a second compression section 1-5*b*. The first compression section 1-5*c* and the second compression section 1-5*b* are configured in a form of the double-thread threaded rod. The threaded rod 1-*b* may include a feed section 1-5*d*, a first compression section 1-5*c*, a second compression section 1-5*b* and a metering section 1-5*a* disposed in sequence. Along a material delivering direction in the screw extruder, groove depths of the first compression section 1-5*c* and the second compression section 1-5*b* gradually decrease, and a variation of the groove depth of the second compression section 1-5*b* is less than that of the first compression section 1-5*c*.

The groove depth of the first compression section 1-5*c* gradually decreases, and the variation of the groove depth thereof is relatively large, so that a material in a solid phase is compressed and sheared, and fully melted to a liquid phase, and then passes through the second compression section 1-5*b* with a decreasing groove depth and with a small variation of the groove depth. On the one hand, the material in a solid phase is fully melted into a liquid, and on the other hand, there is a relative space to store the gas generated after hydrolysis. In some embodiments, the above-mentioned variation of the groove depth refers to an amount of variation of the groove depth per unit length along the material delivering direction in the screw extruder. The large variation and small variation of the groove depth are relative to one another.

In some embodiments, as shown in FIG. 16, the threaded sleeve 1-*a* may include an electric contact pressure gauge 1-2. A measurement end of the electric contact pressure gauge 1-2 is exposed to the gas collection chamber 1-3*g*. The gas collection chamber 1-3*g* is used to collect the gas generated by the hydrolysis of the material. A pressure generated when the collected gas reaches a certain volume, is reflected on the electric contact pressure gauge 1-2, and actions of the on-off valve 1-3 are assisted by the electric contact pressure gauge 1-2.

In some embodiments, as shown in FIG. 16 and FIG. 19, the threaded sleeve 1-*a* may include a base seat 1-*c* disposed on an outer edge. The exhaust hole 1-3*d* is in L-shape and disposed within the base seat 1-*c*. Two ends of the exhaust hole 1-3*d* are in communication with the gas collection chamber 1-3*g* and the external atmosphere respectively. The on-off valve 1-3 is mounted on the base seat 1-*c*. The on-off valve 1-3 may include a valve body 1-3*b*, a packing sealer 1-3*c*, a valve stem 1-3*a* and a bushing 1-3*e*. A portion of the valve body 1-3*b* is disposed within the base seat 1-*c* and another portion of the valve body 1-3*b* protrudes from the base seat 1-*c* (as shown in FIG. 19, a portion of the valve body 1-3*b* is disposed within the base seat 1-*c*, and the another portion of the valve body 1-3*b* is exposed from the base seat 1-*c*). The valve stem 1-3*a* is movably penetrated in the valve body 1-3*b*. As the valve body 1-3*b* partially is disposed within the base seat 1-*c*, so that the valve stem 1-3*a* is also movably penetrated in the base seat 1-*c*. The packing sealer 1-3*c* is disposed within the base seat 1-*c* and disposed between the base seat 1-*c* and the valve stem 1-3*a* to seal a gap area between the base seat 1-*c* and the valve stem 1-3*a*, so that the gas is fully discharged from the exhaust hole 1-3*d* when the gas is discharged. An end of the valve stem 1-3*a* is configured to be in a form of arc to close or communicate a L-shaped bend of the exhaust hole 1-3*d*. The bushing 1-3*e* is disposed at the L-shaped bend of the exhaust hole 1-3*d* of the base seat 1-*c*, and the bushing 1-3*e* is configured to abut against an arc surface of an end of the valve stem 1-3*a* to ensure a good leakproofness when the valve stem 1-3*a* closes the exhaust hole 1-3*d*.

By operating a position of the valve stem 1-3*a*, the exhaust hole 1-3*d* is blocked or communicated. In some embodiments, the gas in the gas collection chamber 1-3*g* is discharged by opening the exhaust hole 1-3*d* in conjunction with an indication of the electric contact pressure gauge 1-2.

Figure 20:
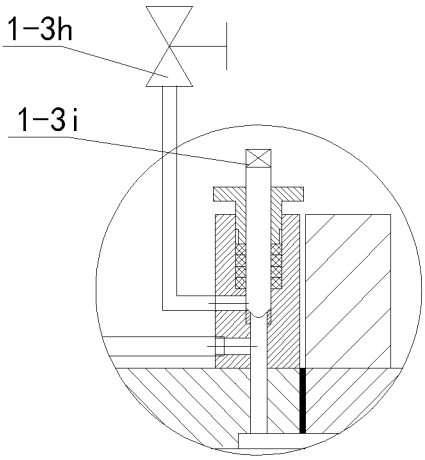
FIG. 20 is a schematic diagram of another embodiment of a structure in FIG. 19.
Figure 21:
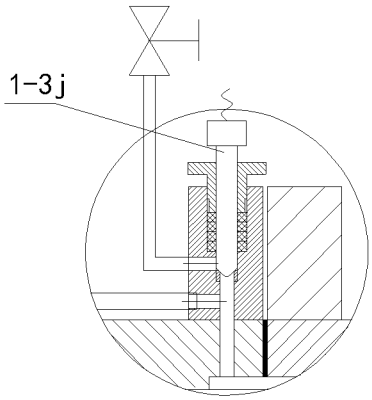
FIG. 21 is a schematic diagram of a further embodiment of the structure in FIG. 19.

In an embodiment, as shown in FIG. 20, the on-off valve 1-3 may be configured as a manual needle valve 1-3*i*. In an embodiment, as shown in FIG. 21, the on-off valve 1-3 may be configured as an electric needle valve 1-3*j*. At this time, the electric needle valve 1-3*j* may be controlled to open at a fixed value in combination with the electric contact pressure gauge 1-2. In an embodiment, as shown in FIG. 19, an end of the exhaust hole 1-3*d* is directly in communication with the external atmosphere. In an embodiment, as shown in FIG. 20 and FIG. 21, an electric vacuum pump 1-3*h* may be added at an end of the exhaust hole 1-3*d* to quickly discharge the gas through pumping. The electric vacuum pump may also be combined with the electric contact pressure gauge 1-2 to control the electric vacuum pump 1-3*h* to automatically start to exhaust the gas at a preset gas pressure.

Figure 17:
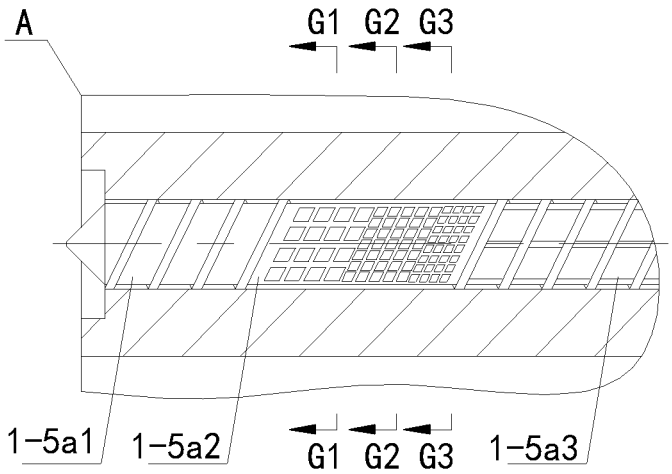
FIG. 17 is a partial structural diagram of a portion indicated by A in FIG. 16.
Figure 18:
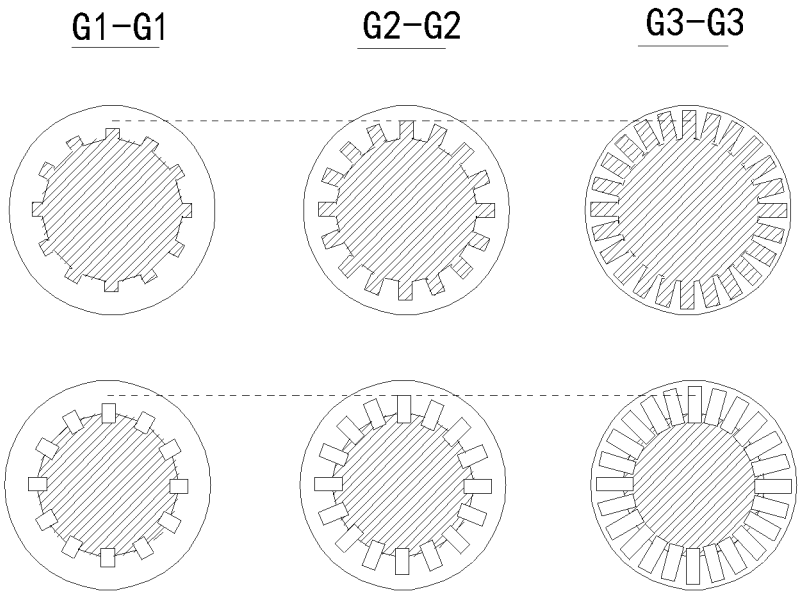
FIG. 18 is a schematic comparison of the cross-sections taken along G1-G1, G2-G2, and G3-G3 in FIG. 17.

In some embodiments, as shown in FIG. 17 and FIG. 18, along the material delivering direction in the screw extruder, the metering section 1-5*a* may sequentially include a first double-thread structure 1-5*a*3, a diamond shape separated structure 1-5*a*2 and a second double-thread structure 1-5*a*1. The diamond shape separated structure 1-5*a*2 is configured as a diamond shape formed by an integrated milling or a diamond pin formed by processing. In some embodiments, an upper row of diagrams in FIG. 18 show an integrated milled diamond shape structure, and a lower row of diagrams in FIG. 18 show a diamond shape separated structure 1-5*a*2 processed from diamond shape pins. The diamond shape separated structure 1-5*a*2 can further promote a mixing and homogenization of the melt.

Figure 24:
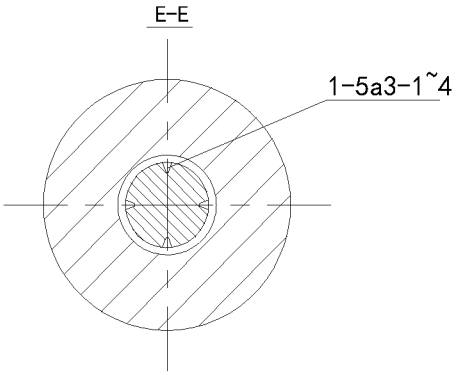
FIG. 24 is a schematic cross-sectional view taken along E-E in FIG. 16.

In some embodiments, as shown in FIG. 24, a portion of a threaded rod of the first double-thread structure 1-5*a*3 is distributed and laid with a plurality of V-shaped grooves 1-5*a*3-1~4 along a spiral annular shape, and the V-shaped groove has a length extending on the entire first double-thread structure 1-5*a*3 to achieve an advantageous effect of reducing unevennesses of the melt about temperature and intrinsic viscosity.

In some embodiments, as shown in FIG. 17 and FIG. 18, along the material delivering direction in the screw extruder, a diameter of the diamond shape separated structure 1-5*a*2 gradually decreases, and a density of distribution of diamonds gradually decreases. In some embodiments, from horizontal dotted lines in FIG. 18, it is shown that the diameter of the diamond shape separated structure 1-5*a*2 gradually decreases to ensure that the material does not flow back and the shear heat is gradually reduced. It can be seen from cross-sectional views G3-G3, G2-G2 and G1-G1 in FIG. 18 that the number of diamonds on the view G3-G3 is greater than that on view G2-G2 and the number of diamonds on the G2-G2 is greater than that on the view G1-G1, and thus it is shown that the density of distribution of diamonds gradually decreases. The higher density at the beginning is advantageous to stir, and a subsequent lower density is advantageous to reduce the shear heat. With such design, there are no dead angles in circulation, and thus no retention of the raw materials, and no carbonization of materials, which is conducive to a continuous operation of the spinning process.

In an embodiment, a length of a single-thread feed section 1-5*d* is configured to be 9D to 11D; a length of a double-thread compression section is controlled to be 10D to 11D; and a length of the metering section 1-5*a* is configured to be 9D to 15D. In an embodiment, a length of the first double-thread structure 1-5*a*3 is configured to be 4D to 10D; a length of the diamond shape separated structure 1-5*a*2 is configured to be 3D; and a length of the second double-thread structure 1-5*a*1 is configured to be 2D. In an embodiment, an aspect ratio of the threaded rod 1-*b* is controlled as (28-34):1. In an embodiment, a temperature of the screw extruder is controlled in zones as 160° C. to 240° C., and a pressure at an outlet of the screw extruder is controlled as 80-120 kg/cm$^2$. In an embodiment, thread ridges of the feed section 1-5*d* have equal diameter and single pitch, and thread ridges of the second double-thread structure 1-5*a*1 have equal distance and equal height, and therefore the melt is fully melted to make the output melt uniform and stable and the pressure at the outlet of the screw extruder is sable, thereby facilitating subsequent spinning to achieve quantitative, constant-pressure and constant-temperature extrusion from a machine head in mixing and extrusion section.

Embodiment Six

Based on the combined spinning-drawing-winding machine for industrial polylactic-acid fiber of Embodiment Three, Embodiment Four or Embodiment Five, referring to FIG. 25 to FIG. 29, this embodiment discloses a spinning box 4, including a metering pump 4-13, a pump plate 4-14, a pump base 4-16, a box pipe 4-18, a melt sealing gasket 4-15*a* and an anti-corrosion sealing gasket 4-15*b*. The metering pump 4-13, the pump plate 4-14 and the pump base 4-16 are connected in sequence. The box pipe 4-18 includes the connecting pump plate 4-14 and the pump base 4-16. The pump plate 4-14, the melt sealing gasket 4-15*a*, the anti-corrosion sealing gasket 4-15*b* and the pump base 4-16 are stacked in sequence. The melt sealing gasket 4-15*a* and the anti-corrosion sealing gasket 4-15*b* are both disposed with through holes for the box pipe 4-18 that communicates the pump plate 4-14 and the pump base 4-16 to penetrate therein.

With reference to FIG. 9, a molten raw material enters the spinning box 4 through the melt delivering pipe 3. Specifically, the molten raw material proceeds along the box pipe 4-18 in the spinning box 4, which includes that the molten raw material passes through the pump base 4-16, the pump plate 4-14, the metering pump 4-13 in sequence, and then passes through the pump plate 4-14 and the pump base 4-16 again, and is delivered to the spinning assembly 6 of a lower box 4-1 to form a tow for entering subsequent processes. In some embodiments, a raw material melt is delivered between the pump plate 4-14 and the pump base 4-16, specifically the raw material melt is delivered along a portion of the box pipe 4-18 communicating the pump plate 4-14 and the pump base 4-16. Correspondingly, the pump plate 4-14 and the pump base 4-16 are disposed with corresponding through holes therein for the raw material melt to flow through.

Figure 27:
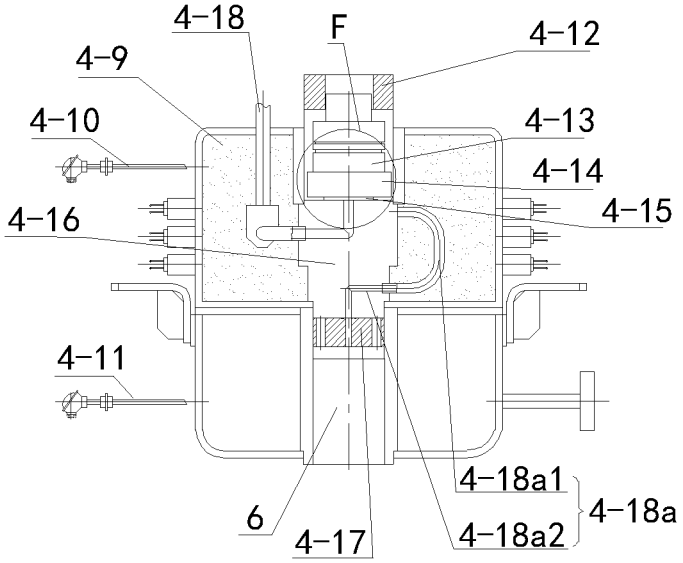
FIG. 27 is a vertical cross-sectional view of the structure shown in the FIG. 25.
Figure 28:
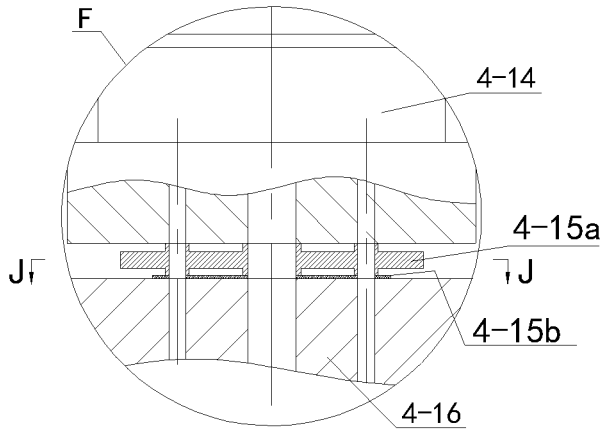
FIG. 28 is a partial enlarged diagram of a portion indicated by F in FIG. 27.

It can be understood that a sealing gasket 4-15 is disposed between the pump plate 4-14 and the pump base 4-16 to enhance the leakproofness of the melt flowing between the pump plate 4-14 and the pump base 4-16. The sealing gasket 4-15 is generally a melt sealing gasket 4-15*a*, specifically as shown in FIG. 27 and FIG. 28. The pump plate 4-14 and the pump base 4-16 are fixedly connected, for example, by screws, so that the melt sealing gasket 4-15*a* is squeezed to seal. On the basis of selecting the melt sealing gasket 4-15*a* in this scheme, a sealing gasket 4-15 is also disposed, specifically another layer of anti-corrosion sealing gasket 4-15*b* is disposed between the melt sealing gasket 4-15*a* and the pump base 4-16, and therefore, the pump plate 4-14, the melt sealing gasket 4-15*a*, and the anti-corrosion sealing gasket 4-15*b* and the pump base 4-16 are stacked in sequence. The box pipe 4-18, communicating the pump plate 4-14 and the pump base 4-16, is disposed to pass through the melt sealing gasket 4-15*a* and the anti-corrosion sealing gasket 4-15*b* accordingly.

With the above anti-corrosion sealing gasket 4-15*b*, a corrosion on a surface of the pump base 4-16 caused by a liquid raw material with a weak acidity is eliminated, and a smoothness of the surface of the pump base 4-16 is protected, and in turn a good leakproofness of the melt sealing gasket 4-15*a* is ensured, and therefore unfavorable situations such as end breakage caused by sealing defects, or a material leakage due to the corrosion of the pump base 4-16 which lead to an insufficient supply of the raw material melt, are improved, which is beneficial to a production of yarn with the raw material melt of weakly acidic, such as the industrial polylactic-acid fiber yarn.

Figure 29:
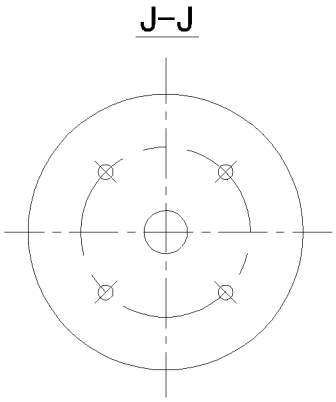
FIG. 29 is a schematic cross-sectional view taken along J-J in FIG. 28.

As shown in FIG. 29, there is a large middle pipe for the raw material melt to flow from the pump base 4-16 through the pump plate 4-14. The melt after being acted upon by the metering pump 4-13 will be delivered into a plurality of pipes, which may be four small pipes around the large middle pipe as shown in FIG. 29. The raw material melt passes through the pump plate 4-14 and the pump base 4-16 until the raw material melt enters the spinning assembly 6 corresponding to the small pipes. There are a plurality of spinning assemblies 6 distributed along a length direction on a bottom side of an assembly connecting plate 4-17, and each spinning assembly 6 has an inlet.

Figure 26:
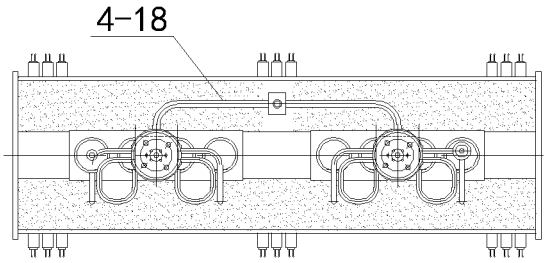
FIG. 26 is a horizontal cross-sectional view of a structure shown in the FIG. 25.

As shown in FIG. 26, the spinning box 4 disclosed in this embodiment includes two pump seats 4-16. The pump bases 4-16 are respectively disposed with a pump plate 4-14, a metering pump 4-13, a spinning assembly 6 and corresponding pipes. As the function of the metering pump 4-13 is to continuously and accurately supply the melt to the spinning assembly 6 with high pressure, there are requirements for high-precision metering accuracy. A metering-pump transmission component 5 of the metering pump 4-13 as shown in FIG. 9 is driven by a permanent magnet synchronous motor directly coupled with a cycloid pinion reducer through a frequency control of speed. Each pump is driven independently. A transmission shaft may be telescopic, and is equipped with a universal spindle coupling and a safety-pin protection device.

In some embodiments, as shown in FIG. 27, the spinning box 4 may include a heat distribution block 4-12. The heat distribution block 4-12 is disposed between the metering pump 4-13 and a shell of the spinning box 4. The heat distribution block 4-12 is disposed to enclose the metering pump 4-13 to improve a thermal insulation effect on the metering pump 4-13.

In some embodiments, the anti-corrosion sealing gasket 4-15*b* is made of corrosion-resistant flexible material, and the corrosion-resistant flexible material includes copper or aluminum. The anti-corrosion sealing gasket 4-15*b* is provided in a form of a copper gasket or an aluminum gasket accordingly. In some embodiments, the pump plate 4-14 and the pump base 4-16 are connected through high-temperature-resistant standard parts. The high-temperature-resistant standard parts include screws made of 35CrMoA. A use of the high-temperature-resistant standard parts makes disassembly, assembly, and replacement easy.

In some embodiments, as shown in FIG. 27, the spinning box 4 may also include an assembly connecting plate 4-17. The assembly connecting plate 4-17 is disposed within the lower box 4-1. The assembly connecting plate 4-17 is used for connecting to the spinning assembly 6. The box pipe 4-18 includes a melt distribution output channel 4-18*a* that communicates the pump base 4-16 and the assembly connecting plate 4-17. The melt distribution output channel 4-18*a* may be disposed in the spinning box 4 in a form of a pipe. The melt distribution output channel 4-18*a* may include a first melt distribution output channel 4-18*a*1 and a second melt distribution output channel 4-18*a*2. An end of the first melt distribution output channel 4-18*a*1 is in communication with the pump base 4-16. An end of the melt distribution output channel 4-18*a*2 is in communication with the assembly connecting plate 4-17, and another end of the first melt distribution output channel 4-18*a*1 is hermetically connected to another end of the second melt distribution output channel 4-18*a*2 by a detachable connector.

Compared with the spinning box in some implementations in which the pump base and the assembly connecting plate are welded and communicated through a plurality of steel pipes serving as melt distribution pipes, so that the pump base, the assembly base and the steel pipes are connected in an inseparable whole, such spinning box has a single function and is not interchangeable. Further since the pump base, the assembly connecting plate and the steel pipe are connected into a whole and the steel pipe has many bends, the pipes are easy to become clogged and are difficult to be cleaned, even with cleaning tools.

With an arrangement of a two-section detachable connection of the melt distribution output channel 4-18*a* of this embodiment, in an optional situation, the first melt distribution output channel 4-18*a*1 and the second melt distribution output channel 4-18*a*2 can be disassembled to meet requirements of interchangeability and expand a scope of application. The arrangement of a two-section detachable connection also facilitates a separate cleaning when clogged, and makes the melt distribution output channel 4-18*a* easier to be cleaned. It can be understood that the two-section detachable connection of the melt distribution output channel 4-18*a* also needs a leakproofness of a connection between the two sections.

Figure 25:
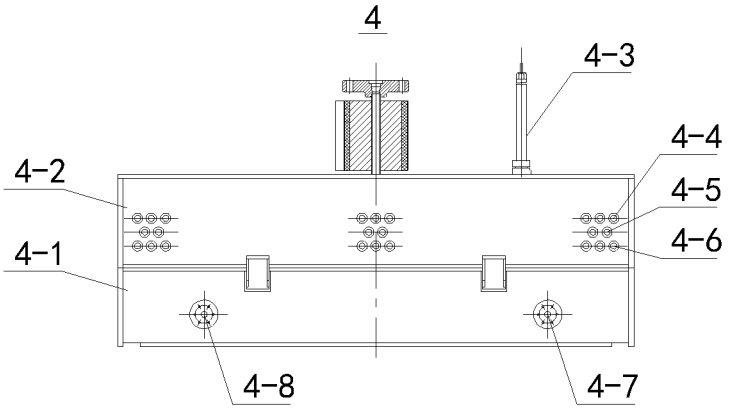
FIG. 25 is a schematic diagram of an overall structure of a spinning box provided in Embodiment Six.

In some embodiments, as shown in FIG. 9, FIG. 25 and FIG. 27, the spinning box 4 may include an upper box 4-2 and a lower box 4-1. The upper box 4-2 is mounted on the lower box 4-1. The metering pump 4-13, the pump plate 4-14 and the pump base 4-16 are mounted vertically in the upper box 4-2 in sequence. The spinning box 4 cooperates with the melt delivering pipe 3. The box pipe 4-18 also communicates the melt delivering pipe 3 and the pump base 4-16. The spinning box 4 is configured in a combination of the upper box 4-2 and the lower box 4-1, which is beneficial to rationally arranging components, reducing a box volume, and is conducive to an assembly process.

In some embodiments, as shown in FIG. 25, the upper box 4-2 is heated by a heater, and a metal filler 4-9 is disposed within the upper box 4-2. A conventional diphyl vapor is replaced by the metal filler 4-9 for transferring heat to achieve an effect of uniform temperature. The heater includes an upper-box basic heater 4-4, an upper-box auxiliary heater 4-5 and an upper-box adjustment heater 4-6, so that one or more groups of different heating modes can be specifically adopted to achieve advantagous effects such as rapid heating, thermal insulation, temperature adjustment and so on.

As shown in FIG. 25, the lower box 4-1 is disposed with a heat-transfer oil inlet 4-7 and a heat-transfer oil outlet 4-8. The heat-transfer oil inlet 4-7 and the heat-transfer oil outlet 4-8 are in communication with a configured container-type of heat-transfer oil boiler, and correspondingly a pump is provided for pumping. With the arrangement of the upper box 4-2 and the lower box 4-1 and a combination of respective heating ways, a heating and a temperature control of the upper box 4-2 and the lower box 4-1 are independently controlled and are interrelated to one another.

In some embodiments, as shown in FIG. 27, the upper box 4-2 includes an upper-box temperature measuring element 4-10 for detecting the metal filler 4-9 in the upper box 4-2, and the lower box 4-1 includes a lower-box temperature measuring element 4-11 for detecting a heat-transfer oil in the lower box 4-1. Furthermore, an intelligent temperature control system can be used, so that an energy consumption can be reduced, thereby being advantageous to environmental protection, and further a feedback data can be provided in time to adjust a heating power. Therefore a temperature can be intelligently controlled, and in turn be controlled to have an accuracy of ±1° C.

In some embodiments, the spinning box 4 includes a pressure-measuring element for melt in spinning box 4-3 mounted on the upper box 4-2. As an initial pressure of the spinning assembly 6 needs to be greater than 9 Mpa during normal spinning, the pressure-measuring element for melt in spinning box 4-3 provides a data support for normal spinning.

In some embodiments, when the spinning box 4 is in use, a temperature inside the upper box 4-2 is controlled as 210° C. to 225° C. The temperature inside the upper box 4-2 is relatively lower, in order to mainly protect the melt during delivering to be in a low-temperature dormant state, so as to reduce degradation and hydrolysis of materials. A temperature inside the lower box 4-1 when in use is controlled as 225° C. to 245° C., in order to increase a fluidity of the melt in the spinning assembly 6 after passing through the assembly connecting plate 4-17, and therefore the melt can be mixed more thoroughly to achieve an effect of more uniform pressure increasing within an assembly and various irregularities of the tow can be reduced.

Embodiment Seven

Figure 30:
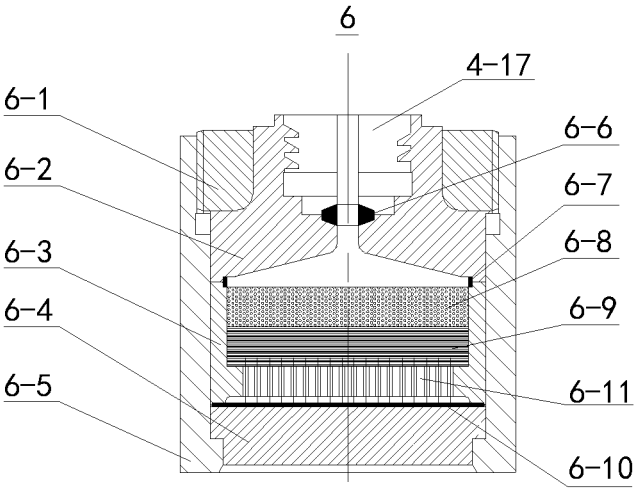
FIG. 30 is a schematic structural diagram of a spinning assembly provided in Embodiment Seven.

Referring to FIG. 30, based on the combined spinning-drawing-winding machine for industrial polylactic-acid fiber of Embodiment Three, Embodiment Four, Embodiment Five, Embodiment Six, this embodiment discloses a spinning assembly 6, which includes an assembly body 6-5, a gland 6-2, a melt distribution body 6-3, a multi-layer sieve 6-10, a spinneret 6-4, a ball layer 6-8, a filter layer 6-9 and a distribution plate 6-11. The gland 6-2, the melt distribution body 6-3, the multi-layer sieve 6-10 and the spinneret 6-4 are sequentially disposed in an inner channel of the assembly body 6-5 along a flowing direction of melt. The ball layer 6-8, the filter layer 6-9 and the distribution plate 6-11 are sequentially disposed in the inner channel of the melt distribution body 6-3 along the flow direction of melt. The ball layer 6-8 includes a plurality of balls placed on the filter layer 6-9.

In some embodiments, the assembly body 6-5 serves as a main shell of the spinning assembly 6. The assembly body 6-5 is provided with an inner channel. The gland 6-2, the melt distribution body 6-3, the multi-layer sieve 6-10 and the spinneret 6-4 are sequentially arranged in the inner channel of the assembly body 6-5. The gland 6-2 makes the remaining components to be mounted in the assembly body 6-5. The melt distribution body 6-3 is also disposed with an inner channel therein, and the melt distribution body 6-3 is sequentially disposed with a ball layer 6-8, a filter layer 6-9 and a distribution plate 6-11 in the inner channel. As shown in FIG. 30, the melt distribution body 6-3 and the distribution plate 6-11 can be disposed integrally.

When in working condition, the melt passes through the gland 6-2, and successively passes through the ball layer 6-8, the filter layer 6-9 and the distribution plate 6-11, the multi-layer sieve 6-10 and the spinneret 6-4, and is output as a tow at the spinneret 6-4. This spinning assembly 6 uses balls in the ball layer 6-8 to replace the well-known sea sand. By using ball for filtration, an unfavorable phenomenon of agglomeration of raw materials and sea sand is eliminated, and a service life is prolonged, and it is beneficial for the materials to be mixed more fully in the melt distribution body 6-3, and a uniformity of the melt is improved.

In some embodiments, the filter layer 6-9 is disposed in a form of a sintered metal plate and is made of sintered material. The well-known sea sand and multi-layer sieves 6-10 are replaced by the ball layer 6-8 cooperating with the sintered metal plate. A filter area and volume of the sintered metal plate are about 50% greater than those of the multi-layer sieve 6-10. The spinning assembly 6 of this embodiment uses ball filtration to prevent the raw materials and sea sand from quickly agglomerating, so that the material is made to be mixed more fully in the melt distribution body 6-3. A service life is prolonged, and a uniform of heat transfer of the filter component is improved, and the uniformity of the melt is improved. The balls in this embodiment may be made of stainless steel to form stainless steel balls. The balls may also be made of other metal materials.

In some embodiments, as shown in FIG. 30, the spinning assembly 6 also includes a locking nut 6-1. An outer periphery of the locking nut 6-1 is threadedly connected to an inner side of the assembly body 6-5. An inner periphery and a bottom side of the locking nut 6-1 abut against the outer periphery of the gland 6-2. When the locking nut 6-1 is tightened, the locking nut 6-1 is tightly connected to the assembly body 6-5, and the gland 6-2 is tightly pressed against within the inner channel of the assembly body 6-5. When the spinneret 6-4 at another end is blocked in the inner channel of the assembly body 6-5, a state that the gland 6-2, the melt distribution body 6-3, the multi-layer sieve 6-10 and a spinneret 6-4 tightly abut against with one another in sequence can be formed, and the gland 6-2, the melt distribution body 6-3, the multi-layer sieve 6-10 and a spinneret 6-4 can be mounted firmly in the assembly body 6-5.

In some embodiments, as shown in FIG. 30, a limiting portion is disposed on an inner side of the assembly body 6-5 away from the locking nut 6-1. The limiting portion is fitted with the spinneret plate 6-4 in a concave-convex way to limit the spinneret 6-4 within the module body 6-5. A side of the assembly body 6-5 away from the locking nut 6-1 is fitted with the spinneret 6-4 in the concave-convex way. Specifically, an inner edge of the assembly body 6-5 protrudes inward and is disposed with a limiting portion. The limiting portion may be annular. A periphery of the spinneret 6-4 is disposed in a step-like manner, and the spinneret 6-4 is limited in the inner channel of the assembly body 6-5 through the limiting portion. Especially in a state that the locking nut 6-1 is mounted, the limiting portion is closely connected to the spinneret 6-4.

In some embodiments, as shown in FIG. 30, the gland 6-2 is disposed with internal threads, and the internal threads are configured to connect with the assembly connecting plate 4-17 in the spinning box, thereby realizing a fixed connection between the spinning assembly 6 and the spinning box.

In some embodiments, as shown in FIG. 30, the spinning assembly 6 includes a first sealing member 6-6, which is disposed between the gland 6-2 and the assembly connecting plate 4-17. It can be understood that, on the basis that the gland 6-2 is provided with a path channel for the melt to pass through, the first sealing member 6-6 may be annular and disposed around the path channel, and is disposed between the gland 6-2 and the assembly connecting plate 4-17 to seal a gap between the sealing gland 6-2 and the assembly connecting plate 4-17. In some embodiments, as shown in FIG. 30, the spinning assembly 6 includes a second sealing member 6-7. The second sealing member 6-7 is disposed at a connection between the gland 6-2 and the melt distribution body 6-3. The second sealing member 6-7 may be disposed in a way of embedding to seal an interface surface between the gland 6-2 and the melt distribution body 6-3.

In an embodiment, the gland 6-2, the melt distribution body 6-3, the multi-layer sieve 6-10 and the spinneret 6-4 are disposed vertically in sequence. The ball layer 6-8, the filter layer 6-9 and distribution plates 6-11 are disposed vertically in sequence, and the entire spinning assembly 6 is disposed vertically in the spinning device.

Embodiment Eight

Referring to FIG. 31 to FIG. 34, based on the combined spinning-drawing-winding machine for industrial polylactic-acid fiber of Embodiment Three, Embodiment Four, Embodiment Five, Embodiment Six, Embodiment Seven, this embodiment provides a combined cooling mechanism 9 including an outer ring blowing component 9-1, a lifting-descending component 9-2 and a side blowing component 9-3 disposed in sequence. The lifting-descending component 9-2 includes a telescopic hose **9-2*a* and a lifting-descending power member 9-2*b*. A top end of the telescopic hose 9-2*a* is in communication with the outer ring blowing component 9-1, and a bottom end of the telescopic hose 9-2*a* is in communication with the side blowing component 9-3. The lifting-descending power member 9-2*b* is disposed between the outer ring blowing component 9-1 and the side blowing component 9-3. The combined cooling mechanism 9 may be separable from the spinning assembly 6. The lifting-descending power member 9-2*b* is configured to drive the outer ring blowing component 9-1 to approach or be away from the spinning assembly 6**.

In some embodiments, the tow of polylactic-acid material coming down from the spinning assembly 6 directly passes through the combined cooling mechanism 9, and sequentially passes through the outer ring blowing component 9-1, the telescopic hose **9-2*a* of the lifting-descending component 9-2, and the side blowing component 9-3 until entering the next step. During a normal spinning process, the lifting-descending power member 9-2*b* lifts the outer ring blowing component 9-1 up to form a tight spinning channel with the spinning assembly 6 therebetween. When a polylactic-acid fiber yarn has been produced for a period of time and a residue of the melt accumulates on a surface of the spinneret, the lifting-descending power member 9-2*b* acts to move the outer ring blowing component 9-1 downward. For specific comparison, please refer to FIG. 31 and FIG. 33, and FIG. 32 and FIG. 34, the outer ring blowing component 9-1 is relatively separated from the spinning assembly 6**, so that the original tight spinning channel is opened with an opening and thus an operating space is left out for cleaning the spinneret, so as to regularly clean the surface of the spinneret. Therefore it is beneficial to quality and normal progress of spinning, and is beneficial to improving an overall efficiency of spinning.

Figure 32:
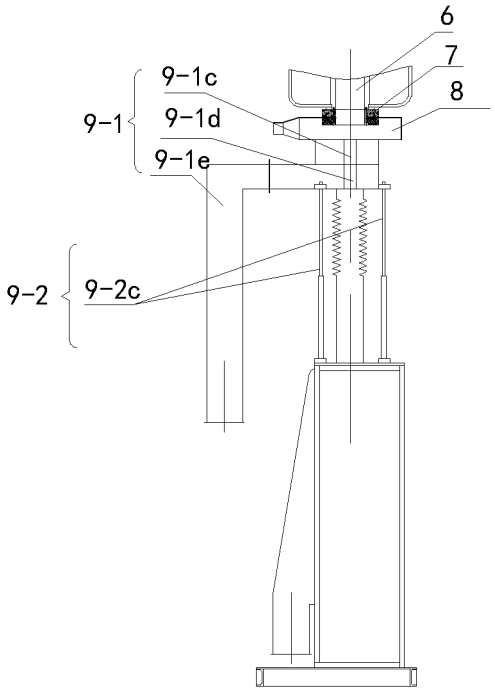
FIG. 32 is a side view of a structure shown in the FIG. 31.
Figure 33:
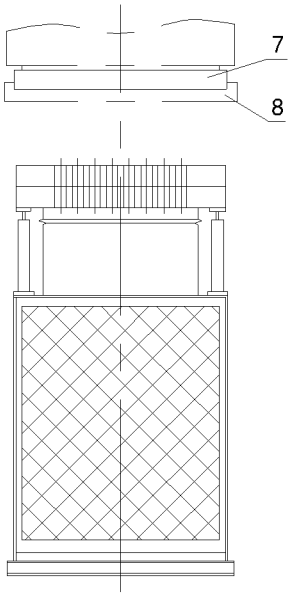
FIG. 33 is a schematic structural diagram of the outer ring blowing component with a falling state in the combined cooling mechanism shown in FIG. 31.
Figure 34:
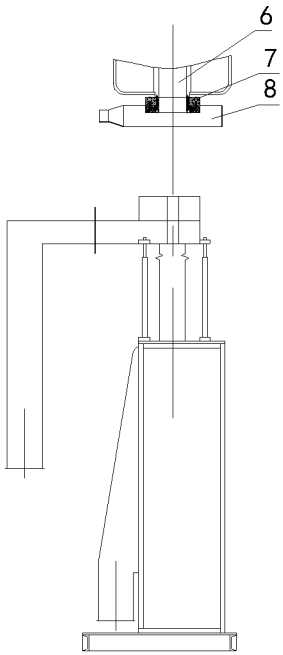
FIG. 34 is a side view of a structure shown in the FIG. 32.

In some embodiments, as shown in FIG. 32, the lifting-descending component 9-2 also includes a vertical movement guide rail **9-2*c*. The vertical movement guide rail 9-2*c* is disposed between the outer ring blowing component 9-1 and the side blowing component 9-3. By providing guide rails, it is beneficial to a stability of movement of the outer ring blowing component 9-1 and the telescopic hose 9-2*a*. In some embodiments, as shown in FIG. 32 and FIG. 34, the vertical movement guide rail 9-2*c* includes a guide rod mounted vertically on the side blowing component 9-3 and a guide block fixed on the outer ring blowing component 9-1, the guide rod penetrating in the guide block. By a restriction of the guide block to the guide rod, it is beneficial to the stability of movement of the outer ring blowing component 9-1 and the telescopic hose 9-2*a***.

In some embodiments, as shown in FIG. 32 and FIG. 34, the lifting-descending power member **9-2*b* includes a cylinder. A cylinder seat of the cylinder is fixed on the side blowing component 9-3, and a piston rod of the cylinder abuts against a bottom side of the outer ring blowing component 9-1. In other embodiments, the lifting-descending power member 9-2*b*** may also be in a form of an oil cylinder, a motor and so on.

Figure 31:
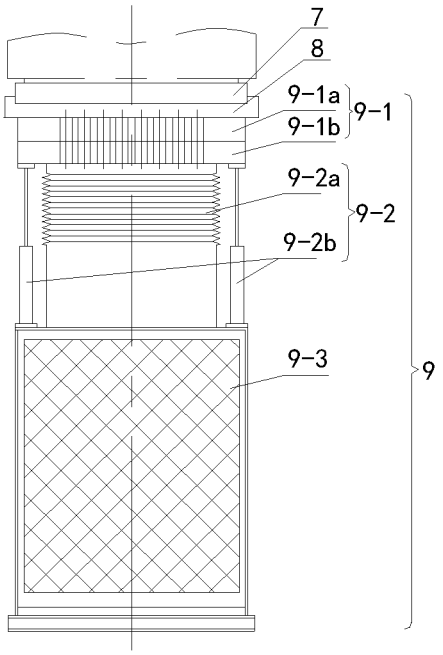
FIG. 31 is a schematic structural diagram of an outer ring blowing component with a raised state in a combined cooling mechanism provided in Embodiment Eight.

In some embodiments, as shown in FIG. 31 and FIG. 32, the outer ring blowing component 9-1 includes an outer ring blowing upper air box **9-1*a*, an outer ring blowing lower air box 9-1***b*, an outer ring blowing air tube 9-1*c*, an outer ring blowing air guide 9-1*d* and the outer ring blowing air inlet duct 9-1*e*. The outer ring blowing upper air box 9-1*a* is stacked on the outer ring blowing lower air box 9-1*b*. The outer ring blowing air tube 9-1*c* is disposed within the outer ring blowing upper air box 9-1*a*. The outer ring blowing air guide 9-1*d* is disposed within the outer ring blowing lower air box 9-1*b*. The outer ring blowing air tube 9-1*c* is disposed on the outer ring blowing air guide 9-1*d*. The outer ring blowing air guide 9-1*d* is disposed therein with an inner channel for the tows to pass through. The tow ejected from the spinning assembly 6 is configured to pass through an inner cavity of the outer ring blowing air guide 9-1*c*, the inner channel of the outer ring blowing air guide 9-1*d*, the telescopic hose 9-2*a* and the side blowing component 9-3 in sequence. An end of the outer ring blowing air inlet duct 9-1*e* is configured as an air inlet, and another end of the outer ring blowing air inlet duct 9-1*e* is in communication with an air guide surface of the outer ring blowing air guide 9-1*d* to guide an incoming air to a gap between the outer ring blowing upper air box 9-1*a* and the outer ring blowing air tube 9-1*c*. A tube surface of the outer ring blowing air tube 9-1*c* is disposed with air holes.

In some embodiments, an air supply system may be used to provide stable and clean hot air to the outer ring blowing component 9-1. Specifically the incoming air may pass through the air inlet of the outer ring blowing air inlet duct 9-1*e*, and is guided to the air guide surface of the outer ring blowing air guide 9-1*d* along the outer ring blowing air inlet duct 9-1*e*. The incoming air can further be guided by the air guide surface of the outer ring blowing air guide 9-1*d* into the outer ring blowing upper air box 9-1*a* and outside the outer ring blowing air tube 9-1*c*, and the incoming air further enters the outer ring blowing air tube 9-1*c* through the air holes on the tube surface of the outer ring blowing air tube 9-1*c*. The tow passing through the tube is slowly cooled by the hot air surrounding the tow. It should be pointed out that the outer ring blowing air tube 9-1*c* may have different heights according to actual needs.

In some embodiments, the tube surface of the outer ring blowing air tube 9-1*c* is made of sintered metal mesh, and the tube surface is covered with non-woven fabric. In the condition that the outer ring blowing air tube 9-1*c* is made of sintered metal mesh, gaps can be formed for the hot air to pass through. In another embodiment, the tube surface of the outer ring blowing air tube 9-1*c* is configured in a form of a porous plate, and is covered with non-woven fabric. The arrangement of the porous plate is to directly open a number of air holes on the outer ring blowing air tube 9-1*c*. The above porous plate or sintered metal mesh has a damping effect, which is beneficial to ensuring a uniform speed and stable air pressure, so that the tow is slowly cooled when surrounded by the hot air.

In some embodiments, along a traveling direction of the tow, an air temperature provided by the outer ring blowing component 9-1 and an air temperature provided by the side blowing component 9-3 form a gradient relationship from high to low with each other; along the traveling direction of the tow, an air speed provided by the outer ring blowing component 9-1 and the air speed provided by the side blowing component 9-3 form a gradient relationship from slow to fast. The above-mentioned "gradient" refers to that, along the traveling direction of the tow, the air temperature changes in a gradually decreasing relationship from section to section, and the air speed changes in a gradually increasing relationship from section to section. By setting of the air temperature and air speed, the tow can be well cooled.

Embodiment Nine

On the basis of the combined spinning-drawing-winding machine for industrial polylactic-acid fiber of Embodiment Three, Embodiment Four, Embodiment Five, Embodiment Six or Embodiment Seven, and the combined cooling mechanism 9 provided in Embodiment Eight, referring to FIG. 31 to FIG. 34, a spinning assembly 6, a heat-retarder 7, a monomer suction component 8 and the combined cooling mechanism 9 are disposed in sequence along a traveling direction of a tow. The spinning assembly 6, the heat-retarder 7 and the monomer suction component 8 are relatively fixedly disposed. An outer ring blowing component 9-1 of the combined cooling mechanism 9 is separably disposed from the monomer suction component 8. The lifting-descending power member 9-2*b* of the combined cooling mechanism 9 may drive the outer ring blowing component 9-1 to approach or be away from the monomer suction component 8.

When a biomass polylactic-acid is spun, monomers, oligomers and so on contained in an ejected melt will volatilize. If the bio-based polylactic-acid tow is cooled immediately, fluidity and tensile properties of the tow will deteriorate and the tow is easily broken. In addition, since a structure of a nascent fiber requires uniformity of inside and outside, at the same time in order to prevent a sudden cooling of the biomass polylactic-acid melt which will cause an entanglement of macromolecular bonds affecting a strength of a finished filament, and in order to ensure a spinning quality, it is necessary to add a heat preservation treatment before a filament coming down from the spinneret enters a blowing cooling process, and therefore a heat-retarder 7 is provided in the combined machine. A heater is disposed within the heat-retarder 7 to perform the heat preservation on a filament, and then the monomer suction component 8 performs a suction treatment on the monomers, oligomers and so on to ensure a quality of tows.

In some embodiments, the heat-retarder 7 may provide a hot air environment of 180-210° C., so that the biomass polylactic-acid melt can be temporarily remained in the hot air of 180-210° C. for a period of time without rapidly cooling. The outer ring blowing component 9-1 in the combined cooling mechanism 9 uses the hot air of 25-35° C. For side blowing, the air conditioning system may be selected to provide stable and clean cooling air. When industrial polylactic-acid filament fibers are spun, the side blowing component 9-3 in the cooling mechanism 9 may provide a cooing air with an air temperature of (19-22° C.)±1° C., an air duct pressure 800 pa, an unevenness of air speed ≤±5%, a relative humidity 85±5%, and an air speed 0.5-0.8 m/s.

It should be understood is that when the side blow cooling is not ideal, physical indicators of the tow will be greatly impacted. If a temperature of the side blowing air is too low, an outer layer of the fiber will solidify rapidly due to a sudden cooling of the fiber, but an inner core of the fiber will still be in a molten state, causing the fiber to form a sheath-core fiber. A draw multiple of the sheath-core fiber will be significantly reduced and a strength will be reduced due to stiffness and hardness. On the contrary, if a temperature of a side blowing cooling device is too high, broken filaments will increase during a production process due to incomplete cooling of the fibers, and even a mutual adhesion phenomenon between single fibers will easily occur during spinning and winding process. This combined machine can ensure a quality of tow fibers by providing and setting the above appropriate side blowing temperature.

Embodiment Ten

On the basis of the combined spinning-drawing-winding machine for industrial polylactic-acid fiber of Embodiment Three, Embodiment Four, Embodiment Five, Embodiment Six, Embodiment Seven, Embodiment Eight or Embodiment Nine, referring to FIG. 35 to FIG. 38, this embodiment provides a double-surface oiling mechanism, including a plurality of pairs of oil nozzles 11-3. Each pair of oil nozzles 11-3 includes two oil nozzles 11-3 respectively located on two sides of a tow 11-4 to be oiled along a radial direction. Each pair of oil nozzles 11-3 are configured to be close to one another in a direction from top to bottom to form a spinning state, and each pair of oil nozzles 11-3 are configured to be away from one another in the direction from top to bottom to form a threading state.

In some embodiments, the tow 11-4 to be oiled is oiled through the plurality of pairs of oil nozzles 11-3. Each pair of oil nozzles 11-3 oils one tow 11-4, and each pair of oil nozzles 11-3 includes two oil nozzles 11-3 located on two sides of the tow 11-4 respectively. The oil nozzles 11-3 are configured to be movable, so that the oil nozzles 11-3 may be at different positions to form a spinning state used for oiling the tow 11-4 and a threading state used for making the tow 11-4 to be threaded and hung, and thus it is convenient for actual operation.

The two sides of the tow 11-4 to be oiled are oiled separately through the oil nozzles 11-3 to achieve a purpose of oiling the two sides of the tow 11-4, thereby increasing bundling and antistatic properties of the polylactic-acid fiber and reducing a tensile resistance of fiber. A function of evenly spraying oil on the tow 11-4 can increase a cohesion property among the monomers in the tow 11-4, and improve a stretching thereby reducing the broken filaments and increasing a full-roller rate of a finished product, which is especially suitable for a drawing and winding for the industrial polylactic-acid filament fiber.

Figure 35:
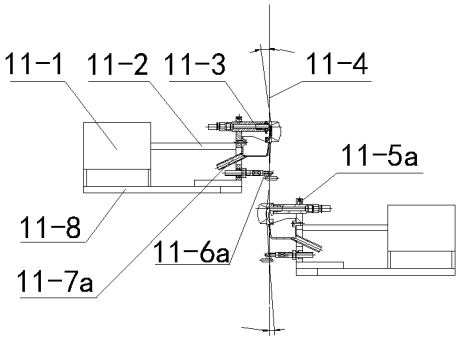
FIG. 35 is a front view of a double-surface oiling mechanism in a spinning state provided in Embodiment Ten.
Figure 36:
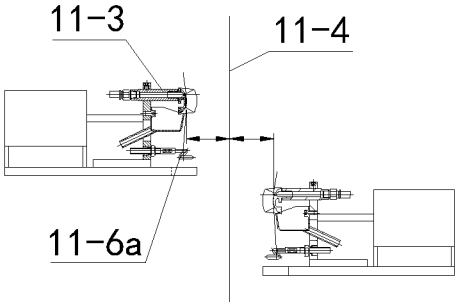
FIG. 36 is a front view of a structure shown in FIG. 35 in a threading state.

In some embodiments, as shown in FIG. 35 and FIG. 36, the two oil nozzles 11-3 belonging to each pair of oil nozzles 11-3 in the plurality of pairs of oil nozzles 11-3 are disposed in staggered manner in a height direction, thereby forming the spinning state as shown in FIG. 29, in which there are an overlapping region between the two oil nozzles 11-3 in the direction from top to bottom, so that the yarn can be hung and the oil nozzle 11-3 can fully oil on the two sides.

In some embodiments, as shown in FIG. 35 and FIG. 36, the double-surface oiling mechanism also includes a first mounting plate 11-5*a*, a cylinder 11-1, a bottom plate 11-8 and a first guiding filament hook 11-6*a*. The mounting plate 11-5*a* is fixedly connected to the oil nozzle 11-3. An end of a cylinder push rod 11-2 of the cylinder 11-1 is fixedly connected to the first mounting plate 11-5*a*. The cylinder 11-1 is fixedly mounted on the bottom plate 11-8. A bottom end of the first mounting plate 11-5*a* is placed to abut on the bottom plate 11-8. The first guiding filament hook 11-6*a* is fixedly mounted on the first mounting plate 11-5*a*, and the first guiding filament hook 11-6*a* is provided at a bottom side of the oil nozzle 11-3. The cylinder push rod 11-2 extends to form the spinning state shown in FIG. 35; the cylinder push rod 11-2 retracts to drive the first mounting plate 11-5*a* and the guiding filament hook 11-6*a* fixedly connected to the first mounting plate 11-5*a* to retreat, to separate each pair of oil nozzles 11-3 to form a threading passage therebetween. In some embodiments, the cylinder 11-1 is equipped with an electrical control system to electrically control the cylinder push rod 11-2 to extend, retract or maintain a stationary state. In other embodiments, the cylinder 11-1 may be replaced by a motor, an oil cylinder or other power components. The cylinder 11-1 has medium with a better cleanability.

In some embodiments, as shown in FIG. 35 and FIG. 36, the double-surface oiling mechanism also includes a first oil receiving box 11-7*a*. The first oil receiving box 11-7*a* is fixedly mounted on the first mounting plate 11-5*a*, and the first oil receiving box 11-7*a* is provided on the bottom side of the oil nozzle 11-3. A top of the first oil receiving box 11-7*a* is provided with an opening to recover the oil falling from the oil nozzle 11-3 during spinning. The first oil receiving box 11-7*a* is also provided with a recovery pipeline to uniformly recover the oil.

Figure 37:
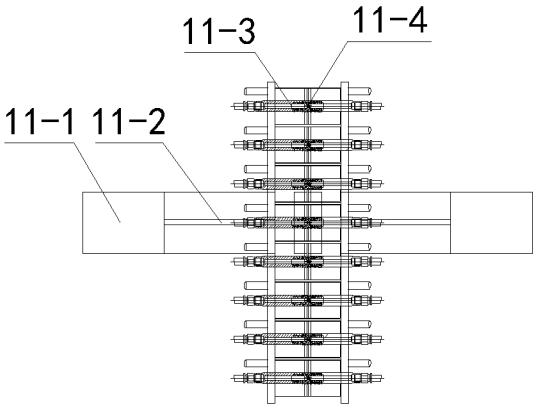
FIG. 37 is a top view of a plurality of structures shown in the FIG. 35 in spinning states.
Figure 38:
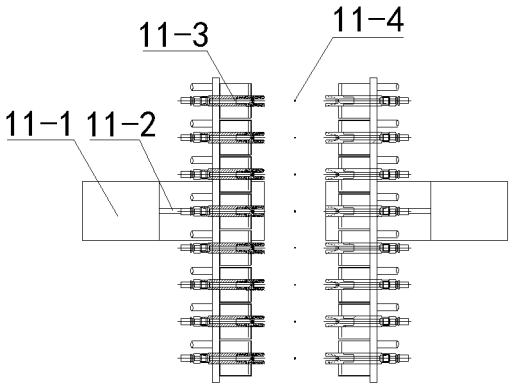
FIG. 38 is a top view of a structure shown in FIG. 37 in the threading state.

In some embodiments, as shown in FIG. 37 and FIG. 38, all oil nozzles 11-3 located on the same side in the radial direction of the tow 11-4 to be oiled are fixedly mounted on the same first mounting plate 11-5*a*, so that the movements of the oil nozzles 11-3 on the same side of all tows 11-4 is easy to be uniformly controlled.

The double-surface oiling mechanism according to some embodiments of the disclosure has the advantages of uniform oil injection, clean oil return, noise pollution eliminated by chain-less transmission, silent transmission, compact structure, and the oil nozzle 11-3 easier to maintain than an oil tanker.

Embodiment Eleven

Figure 39:
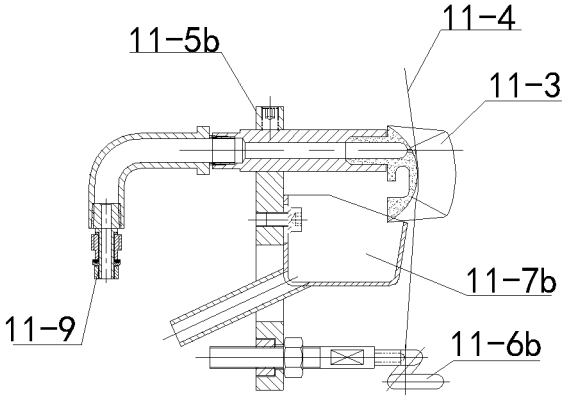
FIG. 39 is a front view of another double-surface oiling mechanism provided in Embodiment Eleven.
Figure 40:
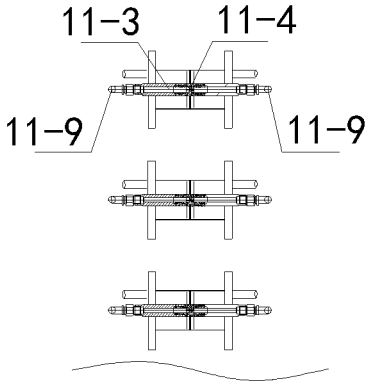
FIG. 40 is a top view of a plurality of the structures shown in the FIG. 39 in spinning states.
Figure 41:
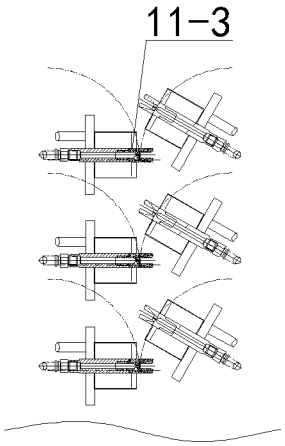
FIG. 41 is a top view of a structure shown in FIG. 40 in the threading state.
Figure 42:
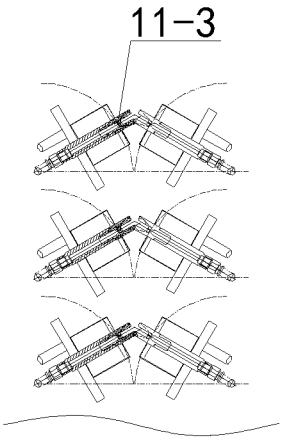
FIG. 42 is another top view of a structure shown in FIG. 40 when the structure is in the threading state.

Based on the double-surface oiling mechanism of the Embodiment Ten, the double-surface oiling mechanism includes a plurality of pairs of oil nozzles 11-3. Each pair of oil nozzles 11-3 includes two oil nozzles 11-3 respectively located on two sides of a tow 11-4 to be oiled along a radial direction. Each pair of oil nozzles 11-3 are configured to be close to one another in a direction from top to bottom to form a spinning state, and each pair of oil nozzles 11-3 are configured to be away from one another in the direction from top to bottom to form a threading state. This embodiment provides another implementation of the double-side oiling mechanism. In some embodiments, as shown in FIG. 39 and FIG. 40, the double-surface oiling mechanism also includes a rotating shaft 11-9. The rotating shaft 11-9 is fixedly connected to the oil nozzle 11-3, and is configured to drive the oil nozzle 11-3 to rotate. In this embodiment, the oil nozzle 11-3 moves by a way of rotation to respectively form a spinning state as shown in FIG. 40 and a threading state as shown in FIG. 41 or FIG. 42.

In some embodiments, as shown in FIG. 39, the double-surface oiling mechanism also includes a second mounting plate 11-5*b*, a second oil receiving box 11-7*b* and a second guiding filament hook 11-6*b*. The second mounting plate 11-5*b* is fixedly connected to the oil nozzle 11-3. The second oil receiving box 11-7*b* is fixedly connected to the second mounting plate 11-5*b*, and the second oil receiving box 11-7*b* is located on a bottom side of the oil nozzle 11-3. The second guiding filament hook 11-6*b* is fixedly connected to the second mounting plate 11-5*b*. The oil is collected through the second oil receiving box 11-7*b*. Mounting positions of the second oil receiving box 11-7*b* and the second guiding filament hook 11-6*b* are provided through the second mounting plate 11-5*b*. When the rotating shaft 11-9 acts, the second mounting plate 11-5*b*, the second oil receiving box 11-7*b*, the second guiding filament hook 11-6*b* and the oil nozzle 11-3 all move with the rotating shaft 11-9.

In some embodiments, the rotating shaft 11-9 includes a damping rotating shaft 11-9. The damping rotating shaft 11-9 can be manually adjusted to be in the threading state when threading, and again adjusted to return to the spinning state when spinning.

The double-surface oiling mechanism according to some embodiments of the disclosure has the advantages of uniform oil injection, clean oil return, noise pollution eliminated by chain-less transmission, silent transmission, compact structure, and the oil nozzle 11-3 easier to maintain than an oil tanker.

In an implementable way of threading, as shown in FIG. 41, the oil nozzles 11-3 in the left column may not move upon threading, and the oil nozzles 11-3 in the right column rotate at a certain angle such as 15° to 30°. At this time, the tows 11-4 each are respectively hung to the oil nozzles 11-3 in the left column first, then the oil nozzles 11-3 in the right columns are rotated back to original positions as shown in FIG. 40, and then the tows 11-4 are respectively hung on the oil nozzle 11-3 in the right column to complete the threading and a hanging of the tow. In an implementable way of threading, as shown in FIG. 42, when threading, the oil nozzles 11-3 in the left and right columns are rotated by a certain angle, such as 15° to 30°. At this time, the tow 11-4 each are respectively hung to the oil nozzles 11-3 in the left and right columns, and then the oil nozzles 11-3 in the left and right columns are rotated back to the original positions to complete the threading and a hanging of the tow.

The above-mentioned embodiments are preferred embodiments of the disclosure which are only used to facilitate the explanation of the disclosure and are not intended to limit the disclosure in any form. Equivalent embodiments with local changes or modifications made by any skilled in the art with common knowledge by using the technical content disclosed in the disclosure which are within the scope of the technical features mentioned in the disclosure and does not depart from the content of the technical features of the disclosure, will still fall within the scope of the technical features of the disclosure.

What is claimed is:

1. A combined spinning-drawing-winding machine for industrial polylactic-acid fiber, comprising a spinning device and a drawing-winding device, wherein the spinning device comprises a screw extruder, an extrusion head, a melt delivering pipe, a spinning box, a spinning assembly, a heat-retarder, a monomer suction component, a combined cooling mechanism and a spinning channel component which are disposed in sequence according to a production process; the drawing-winding device comprises: a double-surface oiling mechanism, a filament shearing-suctioning device, a pre-interlacer, a splitting filament roller, a first pair of low-temperature hot rollers, a second pair of high-temperature drawing hot rollers, a third pair of high-temperature drawing hot rollers, a fourth pair of drawing-setting hot rollers and a fifth group of setting hot rollers, a sixth slacking guide disc, a porcelain guiding filament hook, a main interlacer and a winding machine which are disposed in sequence according to the production process; and a tow sequentially passes, from the spinning channel component, through the double-surface oiling mechanism, the filament shearing-suctioning device and the pre-interlacer until the tow is conveyed to the splitting filament roller; the drawing-winding device and the spinning device are configured as a parallel configuration, so that the tow between the spinning device and the splitting filament roller is arranged in a vertical direction and is tangential to the splitting filament roller;

wherein the spinning assembly comprises:

an assembly body;

a gland, a melt distribution body, a multi-layer sieve and a spinneret which are sequentially disposed in an inner channel of the assembly body; and a ball layer, a filter layer and a distribution plate which are sequentially disposed in an inner channel of the melt distribution body along a flow direction of melt, the ball layer comprising a plurality of balls placed on the filter layer.

2. The combined spinning-drawing-winding machine for industrial polylactic-acid fiber according to claim 1, wherein the fifth group of setting hot rollers comprises:

a thermal insulation cover box, opened with a filament entering channel and a filament out channel for the tow to pass therethrough, at least four heat-setting rollers disposed in sequence according to the production process and each disposed within the thermal insulation cover box; and a heating source used to heat the tow within the thermal insulation cover box in an environment of 70-120° C.

3. The combined spinning-drawing-winding machine for industrial polylactic-acid fiber according to claim 2, wherein the heating source comprises an inductive heating source, a steam heating source or a hot air heating source;

the heating source is, when comprising the inductive heating source, used to heat-set the industrial polylactic-acid fiber yarn with a setting temperature within a first preset range, the heat-setting rollers being all disposed as heat-setting rollers heated through inductive heating;

the heating source is, when comprising the steam heating source, used to heat-set the industrial polylactic-acid fiber yarn with a setting temperature within a second preset range; a steam inlet is opened at a lower portion of a side wall of the thermal insulation cover box, and a steam outlet is opened at a higher portion of the side wall of the thermal insulation cover box; and the steam inlet and the steam outlet are opened at two opposite sides of the thermal insulation cover box, such that the steam heating source deliveries a hot steam into the thermal insulation cover box;

the heating source is, when comprising the hot air heating source, used to heat-set the industrial polylactic-acid fiber yarn with a setting temperature within a third preset range; a plurality of heating plates are provided within the thermal insulation cover box, the heating plates being disposed at an interval from the heat-setting rollers, and being disposed close to the tow in the thermal insulation cover box; and the first preset range, the second preset range and the third preset range decrease in sequence, and are all greater than or equal to 70° C. and less than or equal to 120° C.

4. The combined spinning-drawing-winding machine for industrial polylactic-acid fiber according to claim 2, wherein the splitting filament roller is wound by the tow for 1 circle, the splitting filament roller having a heating temperature of zero° C. and a spinning speed of 550-650 m/min;

the first pair of low-temperature hot rollers are wound by the tow for 6.5 circles to 7.5 circles, the first pair of low-temperature hot rollers having a heating temperature of 65-90° C. and a spinning speed of 605 m/min, the splitting filament roller and the first pair of low-temperature hot rollers maintaining a speed ratio of 1:1.01;

the second pair of high-temperature drawing hot rollers are wound by the tow for 6.5 circles to 7.5 circles, the second pair of high-temperature drawing hot rollers having a heating temperature of 100-140° C. and a spinning speed of 1950 m/min;

a draw multiple of the first pair of low-temperature hot rollers and the second pair of high-temperature drawing hot rollers being 2.5-3.5 times;

the third pair of high-temperature drawing hot rollers are wound by the tow for 6.5 circles to 7.5 circles, the third pair of high-temperature drawing hot rollers having a heating temperature of 110-150° C. and a spinning speed of 3500 m/min;

a draw multiple of the second pair of high-temperature drawing hot rollers and the third pair of high-temperature drawing hot rollers being 1.5-2 times;

the fourth pair of drawing-setting hot rollers are wound by the tow for 6.5 circles to 7.5 circles, the fourth pair of drawing-setting hot rollers having a heating temperature of 110-150° C. and a spinning speed of 3900 m/min; a draw multiple of the third pair of high-temperature drawing hot rollers and the fourth pair of drawing-setting hot rollers being 1.1-1.3 times; and the fifth group of setting hot rollers has a heating temperature of 70-120° C. and a spinning speed of 4250 m/min; a draw multiple of the fourth pair of drawing-setting hot rollers and the fifth group of setting hot rollers being 1.02-1.05 times.

5. The combined spinning-drawing-winding machine for industrial polylactic-acid fiber according to claim 1, wherein the screw extruder comprises a threaded sleeve and a threaded rod penetrating in the threaded sleeve; the threaded rod comprises a feed section, a compression section and a metering section which are disposed in sequence; the threaded sleeve comprises:

a gas collection chamber opened and disposed on an inner wall at a junction of the compression section and the metering section; and an exhaust hole being in communication with the gas collection chamber;

wherein the threaded sleeve is mounted with an on-off valve to open and close the exhaust hole.

6. The combined spinning-drawing-winding machine for industrial polylactic-acid fiber according to claim 1, wherein the spinning box comprises:

a metering pump, a pump plate and a pump base connected in sequence;

a box pipe, used for communicating the pump plate and the pump base; and a melt sealing gasket and an anti-corrosion sealing gasket;

wherein the pump plate, the melt sealing gasket, the anti-corrosion sealing gasket and the pump base are stacked in sequence; the melt sealing gasket and the anti-corrosion sealing gasket are both disposed with through holes for the box pipe that communicates the pump plate and the pump base to penetrate therein.

7. The combined spinning-drawing-winding machine for industrial polylactic-acid fiber according to claim 1, wherein the combined cooling mechanism comprises an outer ring blowing component, a lifting-descending component and a side blowing component which are disposed in sequence; the lifting-descending component comprises a telescopic hose and a lifting-descending power member; a top end of the telescopic hose is communicated to the outer ring blowing component, and a bottom end of the telescopic hose is communicated to the side blowing component; and the lifting-descending power member is disposed between the outer ring blowing component and the side blowing component; and the combined cooling mechanism is separably from the spinning assembly; and the lifting-descending power member is configured to drive the outer ring blowing component to approach or be away from the spinning assembly.

8. The combined spinning-drawing-winding machine for industrial polylactic-acid fiber according to claim 7, wherein the spinning assembly, the heat-retarder and the monomer suction component are relatively fixedly disposed; an outer ring blowing component of the combined cooling mechanism is separably from the monomer suction component; and the lifting-descending power member of the combined cooling mechanism drives the outer ring blowing component to approach or be away from the monomer suction component.

9. The combined spinning-drawing-winding machine for industrial polylactic-acid fiber according to claim 1, wherein the double-surface oiling mechanism comprises a plurality of pairs of oil nozzles; each pair of oil nozzles comprises two oil nozzles respectively located on two sides of a tow to be oiled along a radial direction; each pair of oil nozzles are configured to be close to one another in a direction from top to bottom to form a spinning state; and each pair of oil nozzles are configured to be away from one another in the direction from top to bottom to form a threading state.

10. The combined spinning-drawing-winding machine for industrial polylactic-acid fiber according to claim 1, wherein the splitting filament roller comprises a pair of tension splitting filament rollers or a feeding roller.

11. The combined spinning-drawing-winding machine for industrial polylactic-acid fiber according to claim 2, wherein the fifth group of setting hot rollers comprises four heat-setting rollers which are a first heat-setting roller, a second heat-setting roller, a third heat-setting roller, a fourth heat-setting roller disposed in sequence according to the production process; the tow passes through the filament entering channel and is wound through the first heat-setting roller, the second heat-setting roller, the third heat-setting roller and the fourth heat-setting roller, until the tow passes through the filament out channel; and a height of the first heat-setting roller is disposed to be higher than that of the second heat-setting roller, a height of the third heat-setting roller being equal to that of the first heat-setting roller, a height of the fourth heat-setting roller being equal to that of the second heat-setting roller.

12. The combined spinning-drawing-winding machine for industrial polylactic-acid fiber according to claim 3, wherein the first preset range is greater than 110° C. and less than or equal to 120° C.;

the second preset range is greater than 90° C. and less than or equal to 110° C.; and the third preset range is greater than or equal to 70° C. and less than or equal to 90° C.

13. The combined spinning-drawing-winding machine for industrial polylactic-acid fiber according to claim 12, wherein a heating temperature of the sixth slacking guide disc is zero° C., a surface of a roller shell of the sixth slacking guide disc being made of ceramic.

14. The combined spinning-drawing-winding machine for industrial polylactic-acid fiber according to claim 13, wherein surfaces of roller shells of the splitting filament roller, the first pair of low-temperature hot rollers, the second pair of high-temperature drawing hot rollers, the third pair of high-temperature drawing hot rollers, the fourth pair of drawing-setting hot rollers, the fifth group of setting hot rollers are all made of ceramics.

* * * * *